US010894426B2

(12) United States Patent
Tsuji

(10) Patent No.: US 10,894,426 B2
(45) Date of Patent: Jan. 19, 2021

(54) RECORDING DEVICE

(71) Applicant: SEIKO EPSON CORPORATION, Tokyo (JP)

(72) Inventor: Akina Tsuji, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/573,149

(22) Filed: Sep. 17, 2019

(65) Prior Publication Data

US 2020/0086655 A1 Mar. 19, 2020

(30) Foreign Application Priority Data

Sep. 18, 2018 (JP) ..... 2018-173329

(51) Int. Cl.
*B41J 2/21* (2006.01)
*B41J 2/165* (2006.01)
*B41J 19/14* (2006.01)

(52) U.S. Cl.
CPC ..... *B41J 2/2125* (2013.01); *B41J 2/16508* (2013.01); *B41J 19/142* (2013.01)

(58) Field of Classification Search
CPC .... B41J 2/2125; B41J 2/16508; B41J 19/142; B41J 2/1721; B41J 2/1606; B41J 2/1714; B41J 2/14024; B41J 2002/14362; B41J 2202/11; B41J 11/002
See application file for complete search history.

(56) References Cited

U.S. PATENT DOCUMENTS

2012/0062640 A1* 3/2012 Uraki ..... B41J 11/002 347/18
2013/0120494 A1 5/2013 Mills et al.
2014/0176639 A1 6/2014 Tunmore et al.

FOREIGN PATENT DOCUMENTS

JP 2008-044128 A 2/2008
JP 2017-209934 A 11/2017

* cited by examiner

*Primary Examiner* — Bradley W Thies
(74) *Attorney, Agent, or Firm* — Workman Nydegger

(57) ABSTRACT

A recording device includes a recording head housed in a carriage, and for discharging a droplet on an obverse surface of a medium to perform recording on the medium, a support section having a support surface for supporting a reverse surface of the medium, and a heater for heating the droplet adhered to the obverse surface of the medium. The carriage is provided with a collection section capable of collecting steam generated when the droplet is heated by the heater. The recording head includes a nozzle cover provided with a plurality of holes for discharging the droplet. The nozzle cover includes a nozzle surface opposed to the support surface The collection section is formed of a material higher in hydrophilic property than the nozzle surface.

8 Claims, 22 Drawing Sheets

RECORDING DEVICE

The present application is based on, and claims priority from JP Application Serial Number 2018-173329, filed Sep. 18, 2018, the disclosure of which is hereby incorporated by reference herein in its entirety.

BACKGROUND

1. Technical Field

The present disclosure relates to a recording device.

2. Related Art

In the past, there has been known in public a recording device for recording an image/character on a variety of media (e.g., a roll of paper or a sheet of paper) as described in, for example, JP-A-2008-44128 (Document 1). In such a recording device, ink including a solvent is discharged on a surface of a medium using an inkjet head to thereby record an image/character, and then the solvent is evaporated by heating with a heater (a heating section) to thereby fix the ink on the medium. In the recording device described in Document 1, in order to prevent the steam which is generated when the solvent evaporates from aggregating to condense on a nozzle surface of a recording head, a nozzle plate (the nozzle surface) having electrical conductivity is heated by electromagnetic induction heating.

However, in the recording device described in Document 1, there exists the following problem. For example, depending on the ink type used, when heating the nozzle plate (the nozzle surface), the ink is solidified in the vicinity of the nozzle (hole) formed on the nozzle plate (the nozzle surface) in some cases. When the ink is solidified in the vicinity of the nozzle, there is a possibility that the state of a meniscus changes when the ink is discharged from the nozzle to incur a discharge failure.

SUMMARY

A recording device according to an aspect of the present disclosure includes a carriage configured to reciprocate in a first direction, a recording head housed in the carriage, and configured to discharge a droplet on an obverse surface of a medium to perform recording on the medium, a support section including a support surface configured to support a reverse surface of the medium, and a heating section configured to heat the droplet adhered to the obverse surface of the medium, wherein the carriage is provided with at least one collection section configured to collect steam generated when the droplet is heated by the heating section, the recording head includes a nozzle cover provided with a plurality of holes configured to discharge the droplet, the nozzle cover includes a nozzle surface opposed to the support surface, and the collection section is formed of a material higher in hydrophilic property than the nozzle surface, and is disposed at a lower surface of the carriage, and at a position different from the nozzle surface.

In the recording device described above, a thermal diffusivity per unit volume of the collection section may be lower than a thermal diffusivity per unit volume of the nozzle cover.

In the recording device described above, the at least one collection section may integrally be formed with the carriage.

In the recording device described above, the at least one collection section may include a first collection section and a second collection section, and the first collection section and the second collection section may be disposed to sandwich the recording head in a second direction intersecting the first direction.

In the recording device described above, the at least one collection section may include a collection surface opposed to the support surface, and a distance from the support surface to the collection surface may be equal to a distance from the support surface to the nozzle surface.

In the recording device described above, a surface roughness of the collection surface may be higher than a surface roughness of the nozzle surface.

In the recording device described above, the surface roughness of the collection surface may be no less than 0.012 μm and no more than 6.3 μm.

The recording device described above may further include a wiper configured to have contact with the collection section and is disposed on a path through which the collection section passes.

DESCRIPTION OF EXEMPLARY EMBODIMENTS

Some embodiments of the present disclosure will hereinafter be described with reference to the accompanying drawings. It should be noted that in each of the drawings hereinafter described, the scale sizes of the layers and the members are made different from the actual dimensions in order to make the layers and the members have recognizable dimensions.

Embodiment 1

Figure 1:
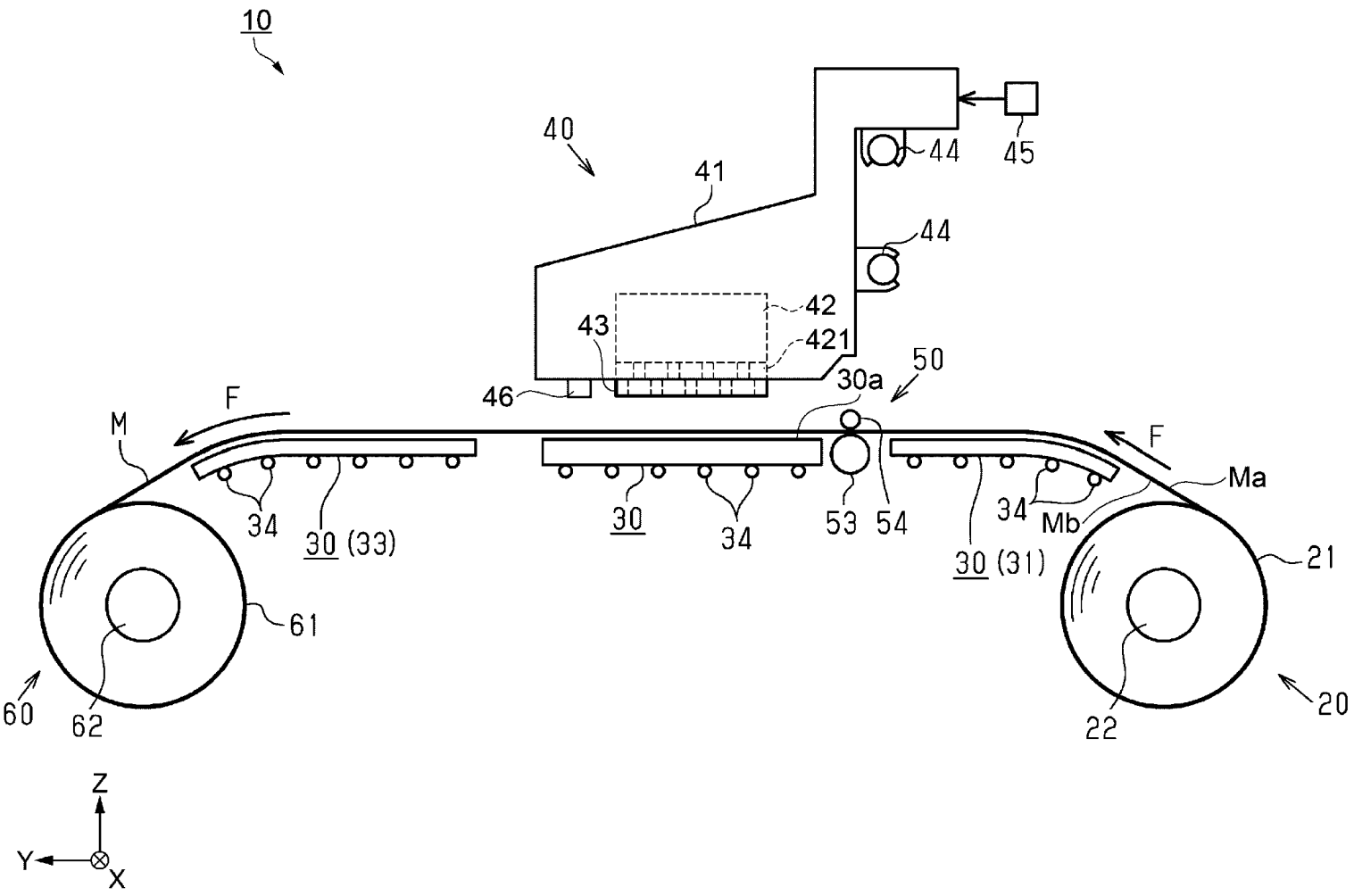
FIG. 1 is a side view of a recording device according to Embodiment 1 viewed from a width direction X(−) side.
Figure 2:
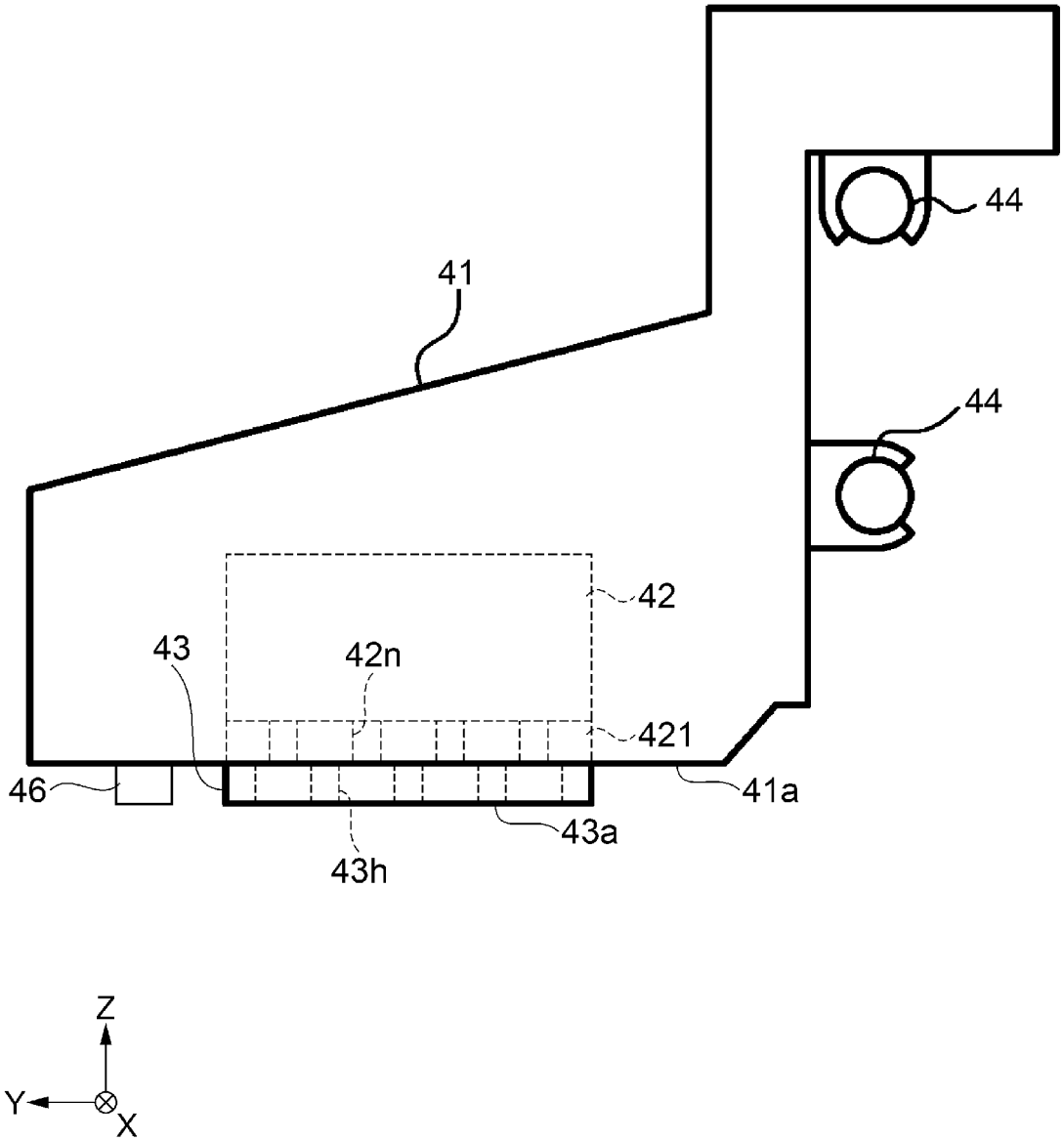
FIG. 2 is a side view of a carriage related to Embodiment 1 viewed from the width direction X(−) side.
Figure 3:
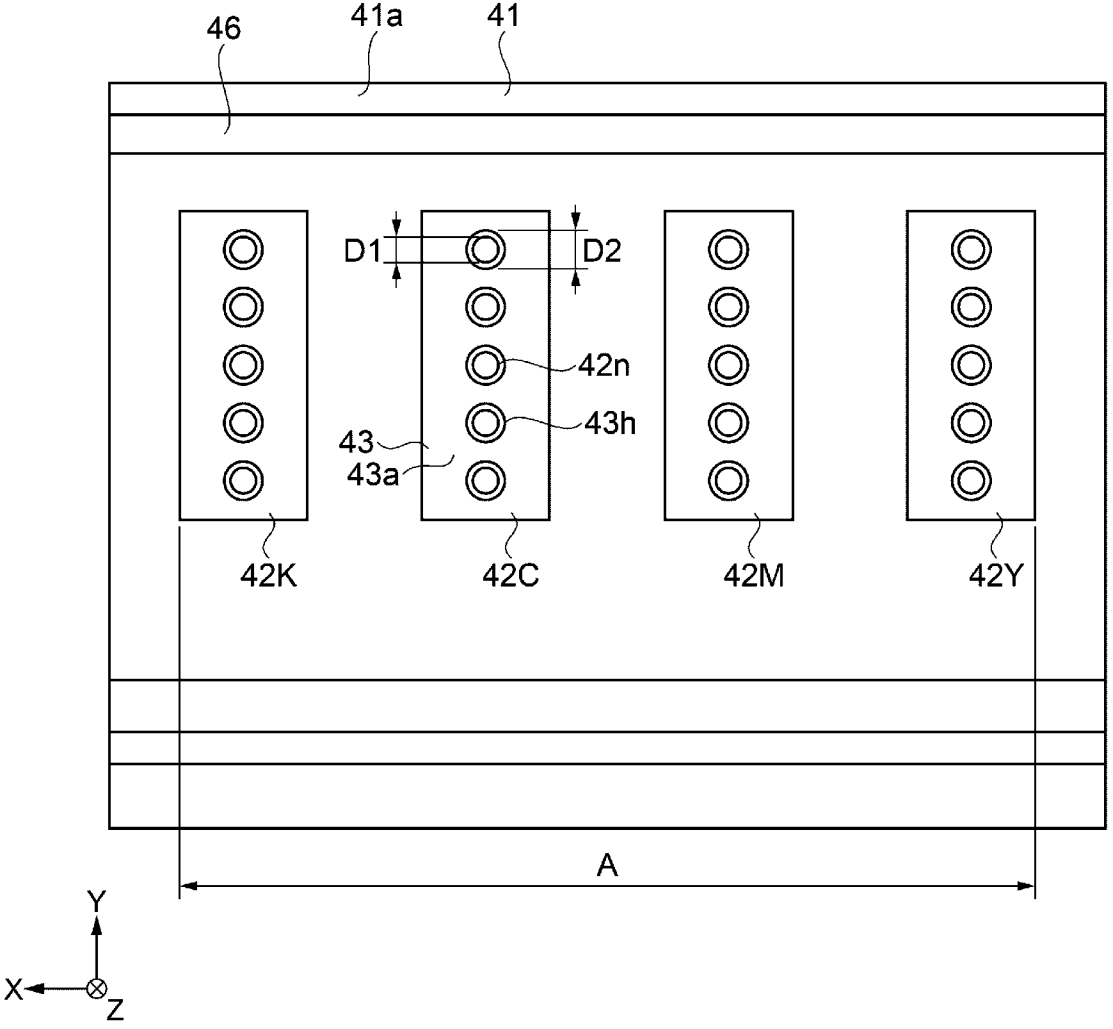
FIG. 3 is a bottom view of the carriage related to Embodiment 1 viewed from a vertical direction Z(−) side.
Figure 4:
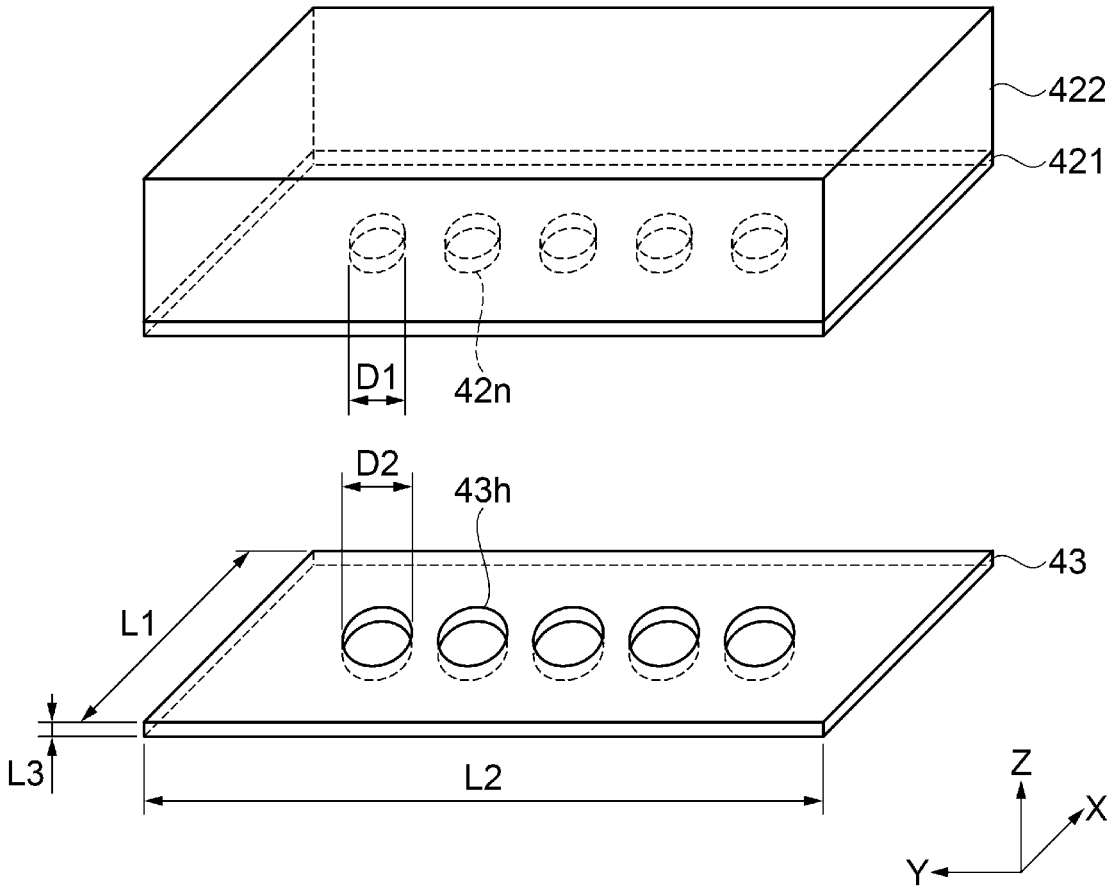
FIG. 4 is a perspective view of a recording head related to Embodiment 1.
Figure 5:
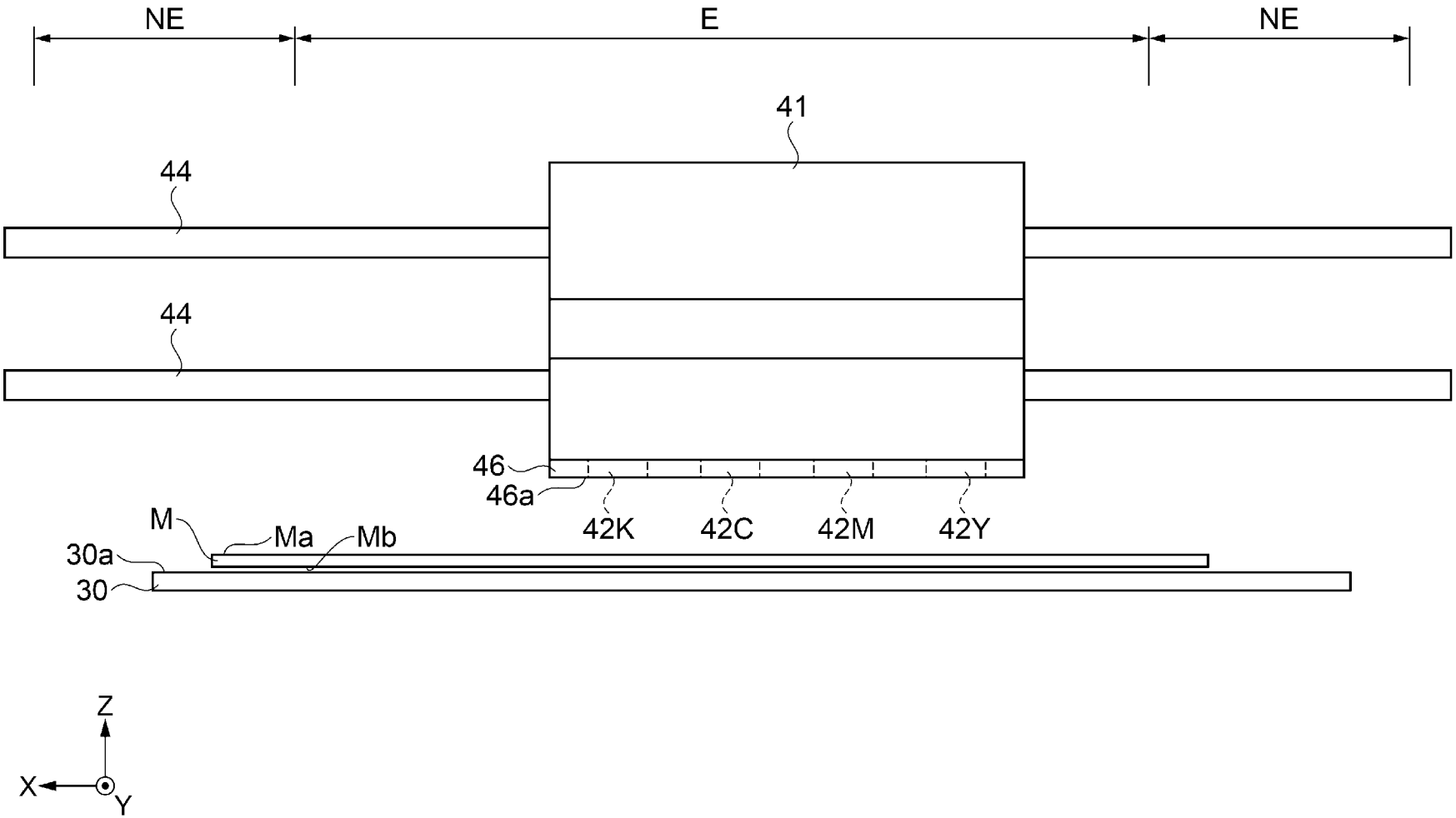
FIG. 5 is a front view of a recording section related to Embodiment 1 viewed from a front-back direction Y(+) side.
Figure 6:
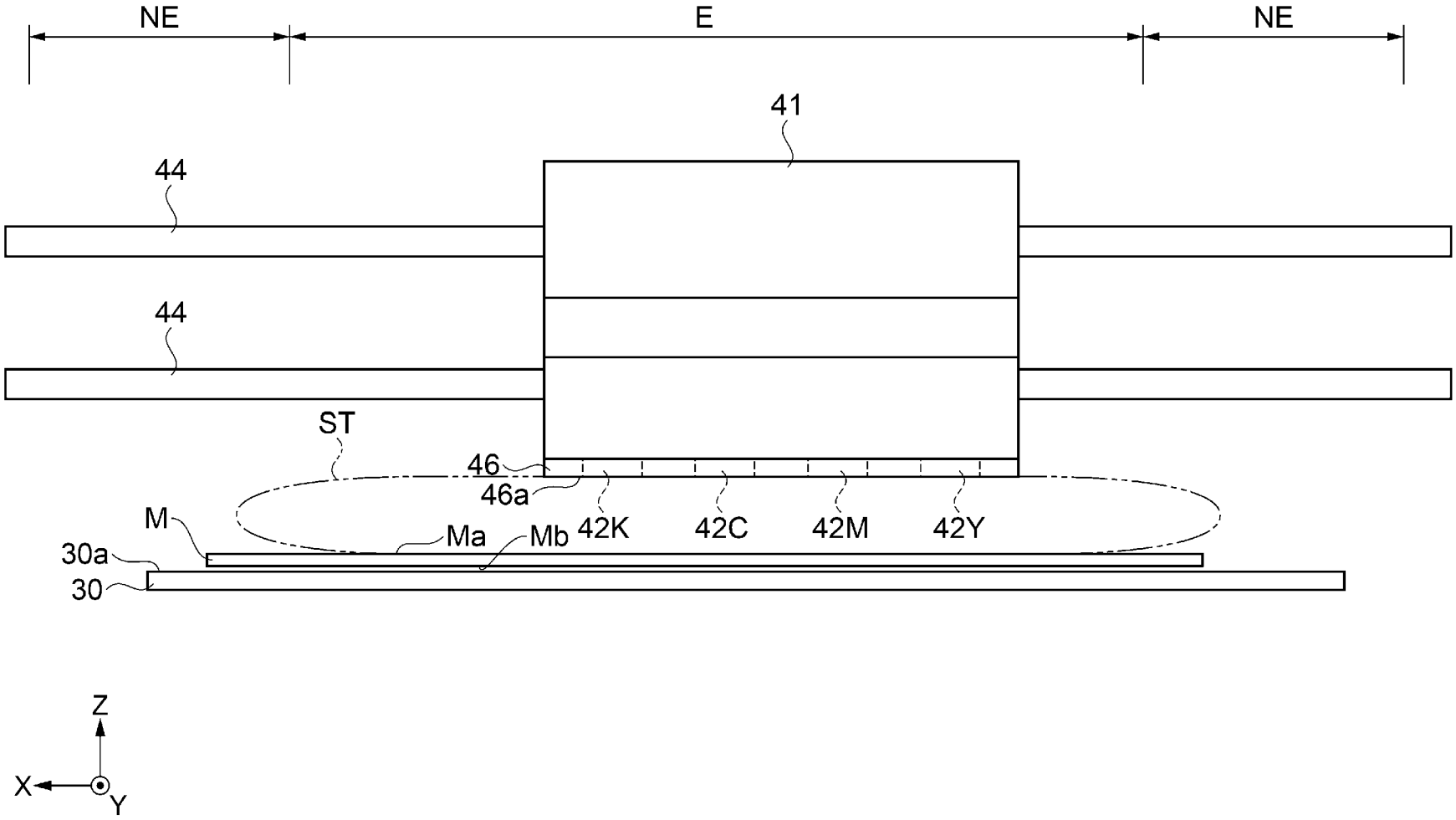
FIG. 6 is a diagram showing a steam generation area in the recording section related to Embodiment 1.
Figure 7:
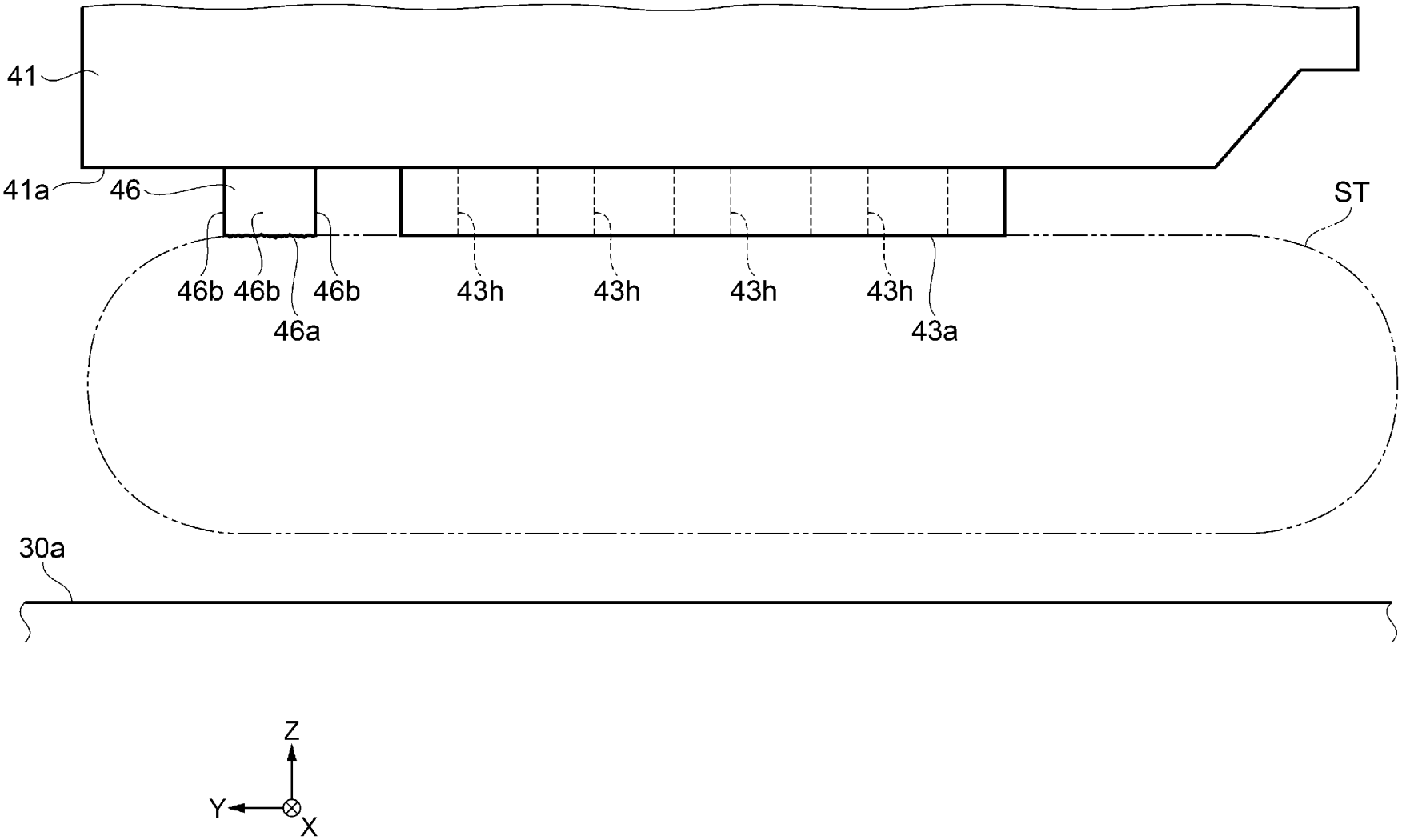
FIG. 7 is a diagram of a side surface of the carriage related to Embodiment 1 viewed from the width direction X(−) side in an enlarged manner.
Figure 8:
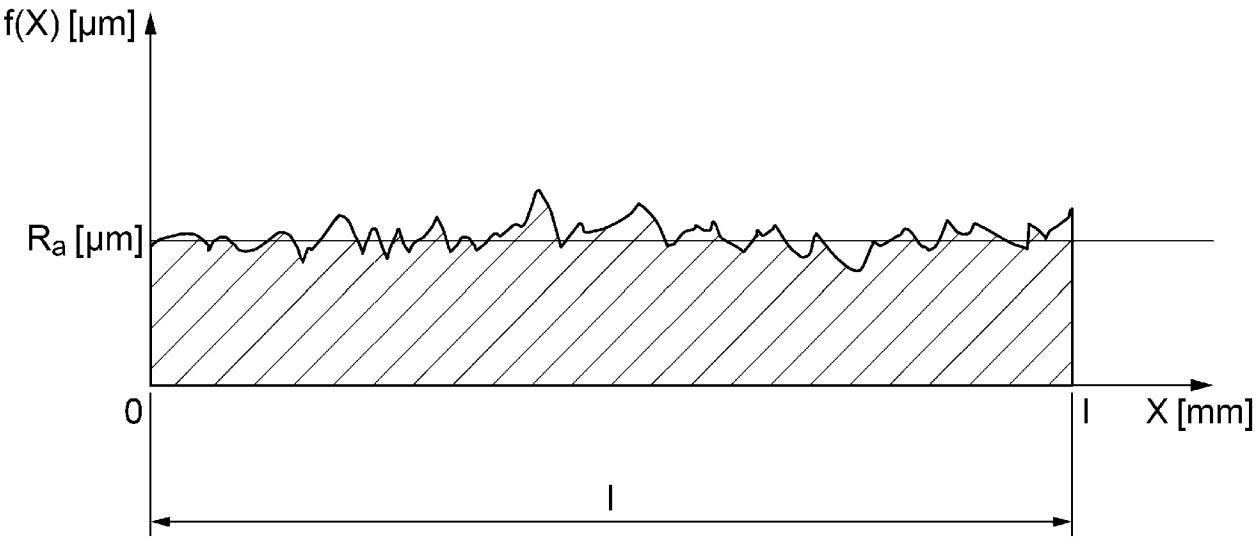
FIG. 8 is a diagram showing an example of a distribution of the surface roughness in the width direction related to Embodiment 1.
Figure 9:
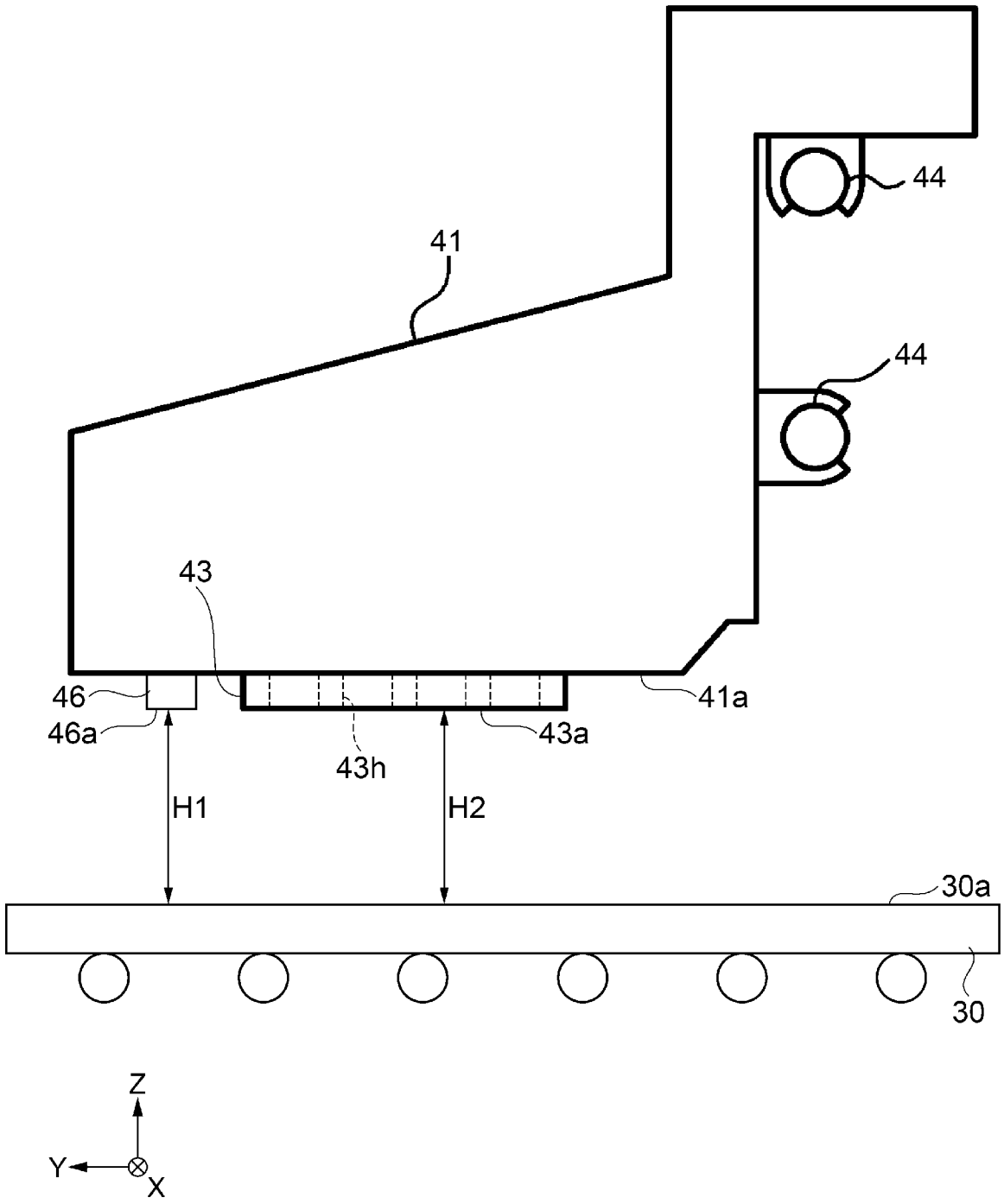
FIG. 9 is a diagram showing a distance between a collection surface and a support surface, and a distance between a nozzle surface and the support surface related to Embodiment 1.

FIG. 1 is a side view of a recording device according to Embodiment 1 viewed from a width direction X(−) side. Further, FIG. 2 is a side view of a carriage related to Embodiment 1 viewed from the width direction X(−) side. Further, FIG. 3 is a bottom view of the carriage related to Embodiment 1 viewed from a vertical direction Z(−) side. Further, FIG. 4 is a perspective view of a recording head related to Embodiment 1. Further, FIG. 5 is a front view of a recording section related to Embodiment 1 viewed from a front-back direction Y(+) side. Further, FIG. 6 is a diagram showing a steam generation area in the recording section related to Embodiment 1. Further, FIG. 7 is a diagram of a side surface of the carriage related to Embodiment 1 viewed from the width direction X(−) side in an enlarged manner. Further, FIG. 8 is a diagram showing an example of a distribution of the surface roughness in the width direction related to Embodiment 1. Further, FIG. 9 is a diagram showing a distance between a collection surface and a support surface, and a distance between a nozzle surface and the support surface related to Embodiment 1. Firstly, a schematic configuration of a recording device 10 according to Embodiment 1 will be described using FIG. 1 through FIG. 3. The recording device 10 according to the present embodiment is a large format printer for printing a character or an image by discharging ink as an example of droplets on an elongated medium (form).

As shown in FIG. 1, the recording device 10 is provided with an unreeling section 20 for performing feeding of the medium M, support sections 30 for supporting the medium M, a recording section 40 for performing printing on the medium M, a conveying section 50 for conveying the medium M, and a winding section 60 for winding the medium M. Further, as shown in FIG. 1 and FIG. 2, the recording device 10 is provided with at least one collection section 46. It should be noted that the material of the medium M is not particularly limited, but it is possible to apply a paper material, a film material, and so on.

It should be noted that in the following description, a width direction of the recording device 10 is defined as a "width direction X," a front-back direction of the recording device 10 is defined as a "front-back direction Y," an upward-downward direction of the recording device 10 is defined as a "vertical direction Z," and a direction in which the medium M is conveyed is defined as a "conveying direction F." In the present embodiment, the width direction X, the front-back direction Y, and the vertical direction Z are directions intersecting (perpendicular to) each other, and the conveying direction F is a direction intersecting (perpendicular to) the width direction X. Further, in the width direction X, the front-back direction Y, and the vertical direction Z, one to which the arrow points is defined as positive, and is expressed as, for example, the width direction X(+). Further, a diagram viewed from the front-back direction Y(+) side is referred to a "front view," a diagram viewed from the vertical direction Z(+) side is referred to as a "top view," and a diagram viewed from the vertical direction Z(−) side is referred to as a "bottom view," and so on.

The unreeling section 20 is provided with an unreeling shaft 22 rotating integrally with a roll body 21 obtained by winding to stack the elongated medium M. Further, the unreeling section 20 rotates the unreeling shaft 22 counterclockwise in FIG. 1 to thereby feed the medium M toward the downstream in the conveying direction F. It should be noted that it is preferable for the unreeling section 20 to adjust the rotational speed of the unreeling shaft 22 to exert tension on the medium M so that "wrinkles" or "crinkles" do not occur in the medium M to be fed to the downstream in the conveying direction F.

The support section 30 supports a reverse surface Mb of the medium M. The support section 30 is made of metal such as aluminum (Al) or stainless steel (SUS), and includes a support surface 30*a* having a substantially planar shape having contact with the reverse surface Mb of the medium M from the vertical direction Z(−) side. In other words, the support sections 30 each have a support surface 30*a* for supporting the reverse surface Mb of the medium M. It should be noted that in FIG. 1, the reverse surface Mb of the medium M is illustrated in the state of being shifted toward the vertical direction Z(+) with respect to the support surface 30*a* for the sake of convenience. In the support sections 30, there are disposed heaters 34 capable of heating the medium M. The heaters 34 in the present embodiment are an example of a heating section, and are disposed at a surface (reverse surface) side on the opposite side to the support surface 30*a* of each of the support sections 30. The heaters 34 are each, for example, a tube heater, and are attached to the reverse surfaces of the support sections 30 via an aluminum tape or the like. Further, by driving the heaters 34, it is possible to heat the support surfaces 30*a* for supporting the reverse surface Mb of the medium M due to thermal conduction. In other words, the support sections 30 are provided with a heating section for heating a droplet having adhered on the obverse surface Ma of the medium M. It should be noted that the three support sections 30 in the present embodiment are disposed along the conveying direction F, but this is not a limitation. Although described later, it is sufficient to support at least an area to which the ink is discharged by the recording heads 42 in the medium M. In this case, it is sufficient for the heaters 34 to be provided to at least the support section 30 for supporting the area to which the ink is discharged by the recording section 40 in the medium M.

Further, it is not required for the support surface 30*a* to be a substantially planar surface. For example, it is also possible to dispose a plurality of ribs which is formed at least one of the width direction X and the front-back direction Y, and can have contact with the reverse surface Mb of the medium M from the vertical direction Z(−). In addition, each heater 34 may not be the tube heater. For example, each heater 34 may be infrared heater or hot-air dryer. In this case, the infrared heater or the hot-air dryer is able to heat the medium M apart from the support surface 30*a*.

The conveying section 50 is for conveying the medium M in the conveying direction F. The conveying section 50 includes a drive roller 53 for applying a conveying force to the medium M, and a driven roller 54 for pressing the medium M against the drive roller 53. Further, the conveying section 50 drives the drive roller 53 in the state of making the drive roller 53 and the driven roller 54 clamp the medium M to thereby convey the medium M toward the downstream in the conveying direction F.

As shown in FIG. 1 and FIG. 2, the recording section 40 is provided with a carriage 41, the recording heads 42, guide shafts 44, a moving mechanism 45, and the support section 30, wherein the carriage 41 reciprocates in the width direction X as a first direction, the recording heads 42 are housed in the carriage 41 and discharges the ink on the obverse surface Ma of the medium M as droplets to perform recording on the medium M, the guide shafts 44 support the carriage 41 so as to be able to move in the width direction X, the moving mechanism 45 becomes a drive source for moving the carriage 41 in the width direction X, and the support section 30 supports at least the area in which an image is recorded by the recording heads 42. Thus, it is possible to discharge the ink to the obverse surface Ma of the medium M while reciprocating in the width direction X using the recording section 40 to thereby record the image or the character. It is conceivable for the moving mechanism 45 to have a configuration of converting, for example, rotary torque of a motor into torque of the reciprocation in the width direction X using a pulley and a transmission belt to drive the carriage 41, but this is not a limitation. Further, the carriage 41 is provided with the at least one collection section 46 capable of collecting the steam generated when the ink is heated by the heaters 34. It should be noted that it is assumed that "water" is used as a solvent in the ink in the present embodiment.

As shown in FIG. 1, the winding section 60 is provided with a winding shaft 62 rotating integrally with the roll body 61 obtained by winding to stack the elongated medium M. Further, the winding section 60 rotates the winding shaft 62 counterclockwise in FIG. 1 to thereby wind the medium M. It should be noted that it is preferable for the winding section 60, similarly to the unreeling section 20, to adjust the rotational speed of the winding shaft 62 to exert the tension in the longitudinal direction on the medium M so that "wrinkles" or "crinkles" do not occur in the medium M.

Then, the detailed configuration of the carriage 41 and the recording heads 42 will be described using FIG. 2 through FIG. 4.

As shown in FIG. 2 and FIG. 3, the recording heads 42 each have a nozzle plate 421 provided with a plurality of nozzles 42*n* for discharging the ink, and a nozzle cover 43 provided with a plurality of holes 43*h* for discharging the ink. The diameter D2 of each of the holes 43*h* is 10% through 30% larger than the diameter D1 of each of the nozzles 42*n*. Therefore, when viewing the nozzle cover 43 from the vertical direction Z(−) side, a part of each of the nozzles 42*n* is exposed from the corresponding one of the holes 43*h*. The plurality of nozzles 42*n* and the plurality of holes 43*h* are arranged in the front-back direction Y in the state in which each of the recording heads 42 is housed in the carriage 41 so that the longitudinal direction of each of the recording heads 42 is parallel to the front-back direction Y.

As shown in FIG. 3, the recording heads 42 are arranged side by side in the width direction X. In the present embodiment, the recording heads 42K, 42C, 42M, and 42Y corresponding to the ink of the respective colors of black (K), cyan (C), magenta (M), and yellow (Y) are arranged in this order from the left side in FIG. 3. It should be noted that the four recording heads 42 in the present embodiment are disposed along the width direction X, but this is not a limitation. The number of the recording heads 42 disposed can be one, or five or more. Further, although the recording heads 42 corresponding to the respective colors of black (K), cyan (C), magenta (M), and yellow (Y) are arranged in the present embodiment, it is also possible to provide the recording head 42 for discharging a pretreatment liquid or a post-treatment liquid for fixing the ink adhering to the obverse surface Ma of the medium M, or the recording head 42 for discharging white ink in addition thereto. Further, the order of the arrangement of the recording heads 42 corresponding to the respective colors is not particularly limited. Further, it is also possible for the recording heads 42 to be arranged in a zigzag manner. It should be noted that a range where nozzle surfaces 43*a* are disposed in the state in which the nozzle surfaces 43*a* are arranged side by side in the width direction X is defined as A.

In each of the recording heads 42, the ink is discharged from the plurality of nozzles 42*n* provided to the nozzle plate 421 due to the drive of piezoelectric elements as drive elements. The nozzle plate 421 is formed of, for example, silicon (Si), and a water-repellent treatment is performed on at least a side opposed to the support surface 30*a*. The nozzle plate 421 is provided with the nozzle cover 43 disposed at the side opposed to the support surface 30*a*. The nozzle cover 43 is formed of, for example, stainless steel (SUS), and is supported by the carriage 41 together with the recording head 42 in the state of adhering to the nozzle plate 421. In other words, the nozzle cover 43 is one of components constituting the recording head 42, and each of the recording heads 42 includes the nozzle cover 43 provided with the plurality of holes 43*h* for discharging the ink. The nozzle cover 43 covers the surface opposed to the support surface 30*a* of the nozzle plate 421. As described above, since the diameter D2 of each of the holes 43*h* provided to the nozzle cover 43 is set larger than the diameter D1 of each of the nozzles 42*n* provided to the nozzle plate 421, it is possible to prevent the discharge of the ink from being hindered by the plurality of holes 43*h* provided to the nozzle cover 43 when the ink is discharged from the plurality of nozzles 42*n*. Further, by covering substantially the entire area except the plurality of holes 43*h* of the nozzle plate 42 on the side opposed to the support surface 30*a*, it is possible for the nozzle cover 43 to prevent the nozzle plate 421 on the side opposed to the support surface 30*a* from being damaged. It should be noted that the number of the nozzles 42*n* provided to the nozzle plate 421 and the number of the holes 43*h* provided to the nozzle cover 43 are five in FIG. 3, but can arbitrarily be changed. Further, the holes 43*h* are arranged at positions corresponding respectively to the nozzles 42*n* in the present embodiment, but this is not a limitation. For example, it is also possible to adopt a shape of a slit having a width in the width direction X of D2, and extending in the front-back direction Y.

As shown in FIG. 4, each of the recording heads 42 includes the nozzle plate 421, a main body part 42, and the nozzle cover 43. The piezoelectric elements described above are incorporated in the main body part 422. Although not shown in the drawings, the main body part 422 is provided with at least one pressure chamber communicated with the plurality of nozzles 42*n* in addition to the piezoelectric elements. The piezoelectric elements are attached to a wall surface constituting the pressure chamber, and when a voltage is applied to the piezoelectric element, the piezoelectric element deforms, and the action of the deformation changes the volume of the pressure chamber. Thus, it is possible for the recording head 42 to discharge the ink from the plurality of nozzles 42*n*.

The nozzle cover 43 is a thin plate-like member having the front-back direction Y as the longitudinal direction. Specifically, the length in the width direction X is L1, the length in the front-back direction Y is L2, and the length in the vertical direction Z is L3, and in the present embodiment, the relationship of L3<L1<L2 is true. In other words, the length L3 in the vertical direction Z is the shortest of the lengths L1, L2, and L3. Here, the diameter D2 of each of the holes 43*h* provided to the nozzle cover 43 is in a range of about 10 through 30 μm. Further, the length L1 in the width direction X of the nozzle cover 43 is about 2 cm, the length L2 in the front-back direction Y of the nozzle cover 43 is about 5 cm, and the length L3 in the vertical direction Z of the nozzle cover 43 is about 0.5 mm. Therefore, the diameter D2 of each of the holes 43*h* is sufficiently smaller than any of the lengths L1, L2, and L3. Further, the nozzle cover 43 includes the nozzle surface 43*a* opposed to the support surface 30*a*. The nozzle surface 43*a* is opposed to the support surface 30*a* so as to be substantially parallel to the support surface 30*a*. Thus, it is possible to prevent landing positions of the ink from being shifted from the desired positions when the ink is discharged from the plurality of nozzles 43*h*.

As shown in FIG. 2 and FIG. 3, the carriage 41 includes a lower surface 41*a* opposed to the support surface 30*a*. The carriage 41 is formed by performing cutting work on aluminum (Al). The lower surface 41*a* is a concept including the whole of a part opposed to the support surface 30*a* out of the carriage 41. The lower surface 41*a* is parallel to the support surface 30*a* in the present embodiment, but it is also possible for the lower surface 41*a*, for example, to be tilted with respect to the support surface 30*a*. Further, the lower surface 41*a* is a substantially planar surface in the present embodiment, but can also be provided with asperity. Further, the nozzle surfaces 43*a* in the present embodiment project toward the vertical direction Z(−) side from the lower surface 41*a* in the present embodiment, but this is not a limitation. For example, it is possible for the nozzle surfaces 43*a* to be coplanar with a plane including the lower surface 41*a*, or can also be located above in the vertical direction the plane including the lower surface 41*a*.

Here, recording of the image on the medium M by the recording section 40 will be described using FIG. 5. As shown in FIG. 5, the recording head 42 is for discharging the ink on the obverse surface Ma of the medium M to record an image, a character, and so on in a recording area E equal to or shorter than a length in the width direction X of the medium M or the support section 30. As described above, it is possible for the recording head 42 to reciprocate in the width direction X in the state of being housed by the carriage 41. In other words, it is possible for the recording head 42 to discharge the ink on the obverse surface Ma of the medium M to form the image, the character, and so on in the recording area E while reciprocating in the width direction X. In the present embodiment, the formation operation of an image, a character, or the like on the obverse surface Ma of the medium M performed by the recording head 42 is referred to as a "recording operation." Further, in the present embodiment, the direction in which the recording head 42 reciprocates coincides with the width direction X, but this is not a limitation. For example, it is also possible for the direction in which the recording head 42 reciprocates to be different from the width direction X.

Further, an area on at least one of the width direction X(+) and the width direction X(−) with respect to the recording area E is a non-recording area NE in which the recording operation by the recording head 42 is not performed. Although not illustrated, the non-recording area NE can be used as a maintenance position. For example, it is possible to dispose a wiper for wiping ink mists attached to the nozzle surfaces 43*a*, a flashing unit for suctioning the ink which has adhered to the nozzle surfaces 43*a* to be solidified in the plurality of nozzles 42*n* and the plurality of holes 43*h*, and so on in the non-recording area NE. In the present embodiment, the non-recording areas NE are disposed at both of the width direction X(+) side with respect to the recording area E and the width direction X(−) side with respect to the recording area E, but this is not a limitation.

Further, in the recording area E, there are disposed a pressing section (not shown) for pressing the medium M supported by the support surface 30*a* from the vertical direction Z(+) side (the obverse surface Ma side) toward the support surface 30*a*, or suction holes (not shown) for suctioning the reverse surface Mb of the medium M to make the reverse surface Mb adhere to the support surface 30*a*. In the case of the suction holes, it is preferable that a negative pressure chamber (not shown) shaped like a box and for keeping the pressure lower than the atmospheric pressure, and a suction fan (not shown) for reducing the pressure of the negative pressure chamber to be lower than the atmospheric pressure are disposed at the surface (the reverse surface) side opposite to the support surface 30*a* of the support section 30 in the vertical direction Z. Thus, the ink is discharged from the recording head 42 in the state of suppressing uplift of the medium M on the support surface 30*a* or the like. Thus, it is possible to make the ink land at correct positions to thereby improve the image quality. In other words, the medium M is supported by the support section 30 in at least the part corresponding to the recording area E in which the ink is discharged by the recording head 42.

Then, a configuration and an operation of the collection section 46 will be described in detail using FIG. 2, FIG. 3, and FIG. 6.

As shown in FIG. 2 and FIG. 3, the carriage 41 is provided with the at least one collection section 46 on the front-back direction Y(+) with respect to the nozzle covers 43. In other words, the carriage 41 includes the at least one collection section 46 in the front-back direction Y(+) with respect to the nozzle surfaces 43*a*. In still other words, the collection section 46 is one of the members constituting the carriage 41. It should be noted that it is also possible for the collection section 46 to be disposed only on the front-back direction Y(−) with respect to the nozzle covers 43. The collection section 46 is attached to the lower surface 41*a* of the carriage 41 using an adhesive. Further, the collection section 46 is disposed in a range larger than the range A in which the nozzle surfaces 43*a* are disposed and the same range as the length in the width direction X of the lower surface 41*a* of the carriage 41 in the width direction X. The collection section 46 is formed of a material higher in hydrophilic property than the nozzle surfaces 43*a*. The hydrophilic property described here denotes wettability with respect to water. In other words, the expression that "a material is high in hydrophilic property" is equal to the expression that "a material is high in wettability with respect to water."

The wettability with respect to water is substantially determined by surface energy of the material. The surface energy of the material depends also on the surface roughness of the material besides the force acting between the atoms or the molecules constituting the material. The stronger the force acting between the atoms or the molecules constituting the material is, the higher the surface energy is, and the higher the surface roughness of the material is, the higher the surface energy becomes. The collection section 46 is formed of, for example, aluminum (Al). In other words, the collection section 46 is formed of the same material as the material constituting the carriage 41. In the present embodiment, the collection section 46 is formed of, for example, what is obtained by performing surface fabrication described later on aluminum (Al). To wrap up the above, the collection section 46 is formed of a material higher in hydrophilic property than the nozzle surfaces 43*a*, and at the same time, disposed at the lower surface 41*a* of the carriage 41 and at a position different from those of the nozzle surfaces 43*a*. It should be noted that it is sufficient for the collection section 46 to be disposed at the lower surface 41*a* of the carriage 41 and at a position different from those of the nozzle surfaces 43*a* when viewed from the vertical direction Z, and the arrangement of the collection section 46 is not particularly limited.

Here, generation of the steam and generation of the condensation on the nozzle surfaces 43*a* due to the recording operation of the recording heads 42 will be described using FIG. 6.

FIG. 6 shows the state in which the medium M is heated by the heaters 34 provided to the support section 30 when the recording heads 42 perform the recording operation on the obverse surface Ma of the medium M. Specifically, when an image, a character, and so on are formed on the medium M by the recording heads 42, the medium M is conveyed by the conveying section 50 to the support surface 30*a* of the support section 30 opposed to the nozzle surfaces 43*a* of the recording heads 42.

The recording heads 42 discharge the ink on the obverse surface Ma of the medium M while reciprocating in the width direction X to thereby form an image, a character, and the like on the obverse surface Ma of the medium M. By the heaters 34 disposed at the surface (the reverse surface) side opposite to the support surface 30*a* of the support section 30 in the vertical direction Z heating the medium M, the ink having landed on the obverse surface Ma of the medium M is heated, and thus, the image, the character, and the like are fixed on the obverse surface Ma of the medium M. On this occasion, when the ink is heated, the solvent included in the ink evaporates, and the steam diffuses in at least the recording area E. Although the shape of the steam is generally indeterminate, in order to simplify the description, an area where the steam is generated in at least the vicinity of the recording area E is illustrated as a steam generation area ST in FIG. 6. The solvent is, for example, "water," and the steam is the solvent which is heated to a temperature higher than the evaporation temperature to thereby be evaporated. Therefore, in the steam, there are included a number of water molecules as solvent molecules.

As time elapses, an amount of the steam included in the steam generation area ST increases. When the carriage 41 and the recording heads 42 reciprocate in the width direction X in this state, the carriage 41 and the recording heads 42 pass through the steam generation area ST, and the carriage 41 and the recording heads 42 are exposed to the steam. On this occasion, the nozzle surfaces 43*a* have contact with the steam, and when the temperature of the nozzle surfaces 43*a* and the temperature in the vicinity of the nozzle surfaces 43*a* are equal to or lower than an aggregation temperature of the steam, the steam aggregates to become a liquid on the nozzle surfaces 43*a* to cause the condensation. When the liquid is accumulated on the nozzle surfaces 43*a*, there is a possibility that the liquid enters the plurality of holes 43*h* to incur an operation failure of the recording heads 42.

In contrast, in the present embodiment, the collection section 46 higher in hydrophilic property than the nozzle surfaces 43*a* is disposed at the lower surface 41*a* of the carriage 41 and at a position different from those of the nozzle surfaces 43*a* when viewed from the vertical direction Z. Thus, even when the recording heads 42 pass through the steam generation area ST, the steam tends to adhere to the collection section 46 higher in hydrophilic property than the nozzle surfaces 43*a*. This is because the collection section 46 is higher in wettability with respect to water compared to the nozzle surfaces 43*a*. On this occasion, since it is not the case that the condensation is prevented by heating the nozzle surfaces 43*a*, it is possible to prevent the condensation on the nozzle surfaces 43*a* while preventing the ink from becoming harder in the plurality of holes 43*h* to cause the discharge failure.

Then, the configuration of making the hydrophilic property of the collection section 46 higher than the hydrophilic property of the nozzle surfaces 43*a* will further be described in detail using FIG. 7. FIG. 7 is an enlarged side view of the carriage 41 related to the present embodiment.

As shown in FIG. 7, the collection section 46 includes a first collection surface 46*a* opposed to the support surface 30*a* viewed from the width direction X, and second collection surfaces 46*b* intersecting the first collection surface 46*a*. In particular, the first collection surface 46*a* corresponds to a "collection surface" in the present disclosure. The collection section 46 is a rectangular member elongated in the width direction X viewed from the vertical direction Z(−). The first collection surface 46*a* protrudes toward the vertical direction Z(−) from the lower surface 41*a* of the carriage 41. In the present embodiment, the length of the collection section 46 in the width direction X is substantially equal to the length of the lower surface 41*a* of the carriage 41 in the width direction X, but is not limited thereto.

The surface roughness of the first collection surface 46*a* is higher than the surface roughness of the nozzle surfaces 43*a*. In this case, the surface roughness in the present embodiment represents "arithmetic mean surface roughness $R_a$." The arithmetic mean surface roughness $R_a$ [μm] is defined by the following formula in the width direction X.

$$R_a = 1/1 \int f(X)dX \quad (1)$$

The meaning of Formula (1) will be described using FIG. 8.

FIG. 8 shows an example of a measurement result when measuring the surface roughness of, for example, the first collection surface 46*a* along the width direction X. Firstly, the surface roughness is continuously measured at a plurality of points in the width direction X. The measurement interval is set to an interval up to a place of X=1 mm assuming the origin as X=0 mm, and the measurement interval is expressed as [0,1]. In the measurement interval [0,1], the surface roughness is continuously measured. Then, as shown in FIG. 8, the distribution f(X) of the surface roughness is determined with respect to the width direction X. By integrating the distribution f(X) of the surface roughness in the measurement interval in the width direction X, it is possible to obtain the area, namely the integral value, of a part surrounded by an axis f(X)=0 in the width direction X as a reference axis, the distribution f(X) of the surface roughness, X=0, and X=1. In FIG. 8, the integral value is represented by hatching. By dividing the integral value by the measurement interval, it is possible to obtain the mean value $R_a$ of the surface roughness in the measurement interval. In other words, the mean value $R_a$ of the surface roughness is a mean value of the statistical distribution of the surface roughness with respect to the width direction X in the vertical direction Z perpendicular to a plane including the first collection surface 46*a*. Therefore, the surface roughness is a value related to the vertical direction Z. Hereinafter, the arithmetic mean surface roughness is referred to as "surface roughness $R_a$." It should be noted that since the same applies to the front-back direction Y, the description of the surface roughness in the front-back direction Y will be omitted. Further, although the surface roughness $R_a$ of the first collection surface 46*a* is mentioned, the surface roughness $R_a$ can also be defined with respect to the second collection surface 46*b* in substantially the same manner.

The surface roughness $R_a$ of the first collection surface 46*a* in the present embodiment is a value obtained by such a one-dimensional formula as Formula (1), but this is not a limitation. For example, it is also possible to adopt a value obtained by measuring the distribution f(X,Y) of the surface roughness in a two-dimensional plane including the first collection surface 46*a*, then calculating the surface integral of the distribution f(X,Y) of the surface roughness, and then dividing the surface integral by the area of the two-dimensional plane as the measurement interval.

Here, the adsorption action of the steam due to the fact that the surface roughness $R_a$ of the first collection surface 46*a* is higher than the surface roughness $R_a$ of the nozzle surfaces 43*a* will be described. The "adsorption" in the present embodiment means so-called physical adsorption. The physical adsorption generally occurs on an interface where two or more substances different in phase have contact with each other. For example, an interface between a substance in a vapor phase and a substance in a solid phase is cited. In the present embodiment, the substance in the vapor phase corresponds to the steam, and the substance in the solid phase corresponds to the collection section 46 or the nozzle cover 43. In this case, the first collection surface 46*a* and the second collection surfaces 46*b* where the steam and the collection section 46 have contact with each other correspond to the interface. It should be noted that in the present embodiment, the area of the first collection surface 46*a* when viewing the first collection surface 46*a* from the vertical direction Z(−) side is sufficiently larger than the area of the second collection surfaces 46*b* when viewing the second collection surfaces 46*b* from the front-back direction Y. Therefore, the adsorption action described later is mostly derived from a contribution of the first collection surface 46*a*.

When the surface roughness $R_a$ of the substance in the solid phase is high, the atomic arrangement on the surface (the interface) becomes random compared to when the surface roughness $R_a$ is low. Thus, the surface free energy of the substance in the solid phase increases. Then, the substance in the solid phase tends to adsorb the substance in the vapor phase having contact therewith on the surface (the interface) to adjust the atomic arrangement on the surface (the interface). Specifically, the substance in the solid phase tends to align the atomic arrangement by supplementing the gap in the random atomic arrangement with the atoms or the molecules constituting the substance in the vapor phase. Thus, the surface free energy of the substance in the solid phase decreases, and the stabilization is achieved.

When the collection section 46 provided to the carriage 41 passes through the steam generation area ST together with the carriage 41, the steam is adsorbed to the first collection surface 46*a* due to the action of the physical adsorption described above. Specifically, the fine particles constituting the steam are adsorbed to the first collection surface 46*a* due to the action of the physical adsorption. The steam is constituted by the fine particles each formed of water molecules aggregated with a dust in the air as a nucleus. Therefore, the expression that "the steam is adsorbed" means that the fine particles constituting the steam are adsorbed. When the steam is adsorbed to the first collection surface 46*a*, water molecule layers as many as the number of the water molecules are formed on the first collection surface 46*a*. Subsequently, the steam in the vicinity of the water molecule layers is attracted by the intermolecular force to the water molecule layers. When the temperature in the vicinity of the water molecule layers is equal to or lower than the aggregation temperature, the kinetic energy of the water molecules constituting the steam is drawn, and the steam accumulates as a liquid on the first collection surface 46*a*. It should be noted that the adsorption action is mostly derived from the contribution of the first collection surface 46*a*, but the contribution of the second collection surface 46*b* is nontrivial. In other words, the collection action of the steam by the collection section 46 is realized by the physical adsorption in the first collection surface 46*a* and the second collection surfaces 46*b*, and the aggregation of the steam on the first collection surface 46*a* and the second collection surfaces 46*b*.

To wrap up the above, the collection section 46 in the present embodiment includes the first collection surface 46*a* opposed to the support surface 30*a*, and the surface roughness $R_a$ of the first collection surface 46*a* is higher than the surface roughness $R_a$ of the nozzle surfaces 43*a*. Thus, the first collection surface 46*a* becomes higher in the surface free energy than the nozzle surfaces 43*a*, and therefore, the steam tends more to be adsorbed to the first collection surface 46*a* than to the nozzle surfaces 43*a*. In other words, the first collection surface 46*a* includes substantially the same functional mechanism as a porous material having mesopores defined by IUPAC (International Union of Pure and Applied Chemistry). Thus, it is possible to further prevent the condensation on the nozzle surfaces 43*a*. In general, the surface (the interface) exerting the physical adsorption action is high in hydrophilic property. In other words, the "hydrophilic property" in the present disclosure is a concept including a characteristic that the physical adsorption is exerted by processing the surfaces of the collection section 46 in addition to the surface free energy inherent in the material itself. As a method of processing the surfaces of the collection section 46, there can be cited, for example, cutting work. In other words, it is included that the surface roughness $R_a$ of the first collection surface 46*a* is made higher than the surface roughness $R_a$ of the nozzle surfaces 43*a* by the cutting work to thereby develop the hydrophilic property of the collection section 46. On this occasion, the surface roughness $R_a$ of the nozzle surfaces 43*a* and the surface roughness $R_a$ of the collection section 46 are measured using a known surface roughness measurement device (e.g., an atomic force microscope, a white interferometer, or a laser microscope), and the surface roughness $R_a$ of the first collection surface 46*a* is adjusted so that the surface roughness $R_a$ of the first collection surface 46*a* becomes higher than the surface roughness $R_a$ of the nozzle surfaces 43*a*.

Further, as the method of processing the surfaces of the collection section 46, there can also be cited reformulation. For example, the reformulation can be realized by forming an aluminum oxide layer ($Al_2O_3$) on the first collection surface 46*a* formed of aluminum (Al), and then varying the thickness of the oxide layer formed on the first collection surface 46*a* so that the surface roughness $R_a$ of the first collection surface 46*a* becomes higher than the surface roughness $R_a$ of the nozzle surfaces 43*a*. Besides the above, as the method of processing the surfaces of the collection section 46, it is conceivable to perform a chemical treatment such as etching on the first collection surface 46*a*.

It should be noted that when performing the cutting work on the first collection surface 46*a*, it is preferable to wash the first collection surface 46*a* with an organic solvent such as acetone or water or the like. This is because when performing the cutting work, cutting oil having hydrophobic property is used in some cases in order to cool the material. Specifically, when the cutting oil remains on the first collection surface 46*a*, there is a possibility that the hydrophilic property of the first collection surface 46*a* deteriorates when the cutting oil has the hydrophobic property. In the present embodiment, by washing the first collection surface 46*a* with the organic solvent such as acetone or water or the like after performing the cutting work on the first collection surface 46*a*, it is possible to prevent the hydrophilic property provided to the first collection surface 46*a* from deteriorating. Further, even when performing the reformation or the chemical treatment on the first collection surface 46*a*, it is preferable to wash the first collection surface 46*a*. When using, for example, anodic oxidation as means for forming the aluminum oxide layer ($Al_2O_3$), there is a possibility that an electrolytic solution remains in the first collection surface 46*a*, and the electrolytic solution deteriorates the collection action of the first collection surface 46*a*. Further, when processing the first collection surface 46*a* with the chemical treatment such as wet etching, there is a possibility that an etching solution remains on the first collection surface 46*a*, and the etching solution deteriorates the collection action of the first collection surface 46*a*. Also in these cases, by washing the first collection surface 46*a* with the organic solvent such as acetone or water or the like, the hydrophilic property provided to the first collection surface 46*a* can be prevented from deteriorating.

In the present embodiment, it is preferable for the surface roughness $R_a$ of the first collection surface 46*a* to be not less than 0.012 μm and not more than 6.3 μm. As described above, by, for example, the cutting work and the measurement of the surface roughness, the surface roughness $R_a$ of the first collection surface 46*a* is adjusted so as to be not less than 0.012 μm and not more than 6.3 μm. The size of the particles constituting the steam is within a range of about 0.01 μm through 6 μm although varying with the surrounding environment of the recording device 10. The steam is constituted by the fine particles each formed of water molecules aggregated with a dust in the air as a nucleus as described above. Therefore, by making the surface roughness $R_a$ of the first collection surface 46*a* no less than 0.012 μm and no more than 6.3 μm so as to incorporate the range of the size of the fine particles of the steam, it is possible to take the particles constituting the steam in the first collection surface 46*a* to adsorb the steam to the first collection surface 46*a*. Therefore, the collection action by the collection section 46 can sufficiently be achieved. In other words, this is substantially the same concept as optimizing the size of the mesopores of the porous material in accordance with the particle size of the substance to be adsorbed.

It should be noted that in FIG. 9, the distance H1 between from the support surface 30*a* to the first collection surface 46*a* is equal to the distance H2 between from the support surface 30*a* to the nozzle surfaces 43*a*(H1=H2). The function thereof will be described compared to when the distance H1 from the support surface 30*a* to the first collection surface 46*a* is different from the distance H2 from the support surface 30*a* to the nozzle surfaces 43*a*.

There are two cases when the distance H1 from the support surface 30*a* to the first collection surface 46*a* is different from the distance H2 from the support surface 30*a* to the nozzle surfaces 43*a*. The first case is when the distance H1 from the support surface 30*a* to the first collection surface 46*a* is longer than the distance H2 from the support surface 30*a* to the nozzle surfaces 43*a*. In this case, since the distance for the steam to reach the first collection surface 46*a* becomes longer, there is a possibility that the steam adheres to the nozzle surfaces 43*a* before reaching the first collection surface 46*a*. The second case is when the distance H1 from the support surface 30*a* to the first collection surface 46*a* is shorter than the distance H2 from the support surface 30*a* to the nozzle surfaces 43*a*. In this case, when the steam collected by the first collection surface 46*a* aggregates to become a liquid, there is a possibility that the liquid tends to have contact with the obverse surface Ma of the medium M.

In contrast, the collection section 46 in the present embodiment includes the first collection surface 46*a* opposed to the support surface 30*a*. Further, the distance H1 from the support surface 30*a* to the first collection surface 46*a* is equal to the distance H2 from the support surface 30*a* to the nozzle surfaces 43*a* (H1=H2). In other words, the height from the support surface 30*a* to the first collection surface 46*a* and the height from the support surface 30*a* to the nozzle surfaces 43*a* are equal to each other. Thus, negative effects when the height from the support surface 30*a* to the first collection surface 46*a* and the height from the support surface 30*a* to the nozzle surfaces 43*a* are different from each other are suppressed. Therefore, it is possible to further enhance the collection effect of the steam by the first collection surface 46*a*, and to prevent the liquid which is generated when the steam collected by the first collection surface 46*a* aggregates to become the liquid from having contact with the obverse surface Ma of the medium M to make the obverse surface Ma dirty. It should be noted that in the present embodiment, H1=H2=(about 2 mm) is assumed. Further, as described above, the surface roughness $R_a$ of the first collection surface 46*a* is not less than 0.012 μm and not more than 6.3 μm, and the surface roughness $R_a$ of the first collection surface 46*a* is less than or comparable to several μm. Therefore, since the value of the surface roughness $R_a$ of the first collection surface 46*a* is sufficiently smaller than the distances H1, H2, the influence exerted on the values of the distances H1, H2 by the surface roughness $R_a$ of the first collection surface 46*a* is extremely small. Therefore, it is sufficient for the values of the distances H1, H2 to fulfill H1=H2 in a range of an error including the surface roughness $R_a$ of the first collection surface 46*a* in addition to a variety of measurement errors inherent in a measuring instrument such as a ruler.

Then, thermodynamic characteristics of the carriage 41 and the nozzle covers 43 will be described in detail using FIG. 2 through FIG. 7.

As described above, the condensation occurs due to the phenomenon that the steam aggregates to become the liquid on the first collection surface 46*a* and the second collection surfaces 46*b* when the temperature of the first collection surface 46*a* and the vicinity of the first collection surface 46*a*, and the temperature of the second collection surfaces 46*b* and the vicinity of the second collection surfaces 46*b* are equal to or lower than the aggregation temperature of the steam. In other words, when the temperature of the first collection surface 46*a* and the vicinity of the first collection surface 46*a*, and the temperature of the second collection surfaces 46*b* and the vicinity of the second collection surfaces 46*b* become equal to or lower than the aggregation temperature of the steam, it is possible to enhance the aggregation action of the steam on the first collection surface 46*a* and the second collection surfaces 46*b*. In the present embodiment, in order to enhance the aggregation action of the steam on the first collection surface 46*a* and the second collection surface 46*b*, the thermal diffusivity per unit volume of the collection section 46, $k_C$, is set lower than the thermal diffusivity per unit volume of the nozzle covers 43, $k_{NC}$ ($k_C<k_{NC}$).

Hereinafter, the thermal diffusivity per unit volume, k, will be described. Since the following is a general description related to a substance, the suffixes are not particularly attached. Defining the temperature of the substance as T [K], and time as t [s], a one-dimensional heat conduction equation in the width direction X, for example, is described as follows.

$$mc\frac{\partial T}{\partial t} = -\lambda\frac{\partial T}{\partial X} \tag{2}$$

In Formula (2), m [kg] denotes a mass of the substance, c [J/(kg·K)] denotes the specific heat of the substance, and λ [W/(m·K)] denotes the thermal conductivity of the substance. The mass m of the substance is expressed as m=ρ×V using the density ρ [kg/m$^3$] of the substance and the volume V [m$^3$] of the substance, and therefore, Formula (2) can be rewritten as follows.

$$\frac{\partial T}{\partial t} = \frac{1}{V}\frac{\lambda}{\rho c}\frac{\partial T}{\partial X} \tag{3}$$

In Formula (3), the coefficient λ/(ρ×c) of ∂T/∂X on the right-hand side is what is generally called the thermal diffusivity. In other words, the thermal diffusivity is a value obtained by dividing the thermal conductivity λ of the substance by a product of the density ρ of the substance and the specific heat c of the substance. Further, in Formula (3), ∂T/∂X on the right-hand side is also multiplied by the reciprocal of the volume 1/V as a coefficient besides the thermal diffusivity. In other words, ∂T/∂X on the right-hand side is multiplied by what is obtained by dividing the thermal diffusivity of the substance by the volume V of the substance, as a coefficient. In other words, the coefficient of ∂T/∂X on the right-hand side is the "thermal diffusivity per unit volume, k." From a thermodynamical point of view, the thermal diffusivity per unit volume, k, represents how easy the temperature T of the substance changes with time. As is obvious from Formula (3), the higher the thermal diffusivity per unit volume, k on the right-hand side is, the larger ∂T/∂t on the left-hand side becomes.

For example, it is assumed that thermal energy is supplied to a certain substance. On this occasion, when the thermal diffusivity per unit volume, k, is high, the temperature of the substance rises quickly compared to when the thermal diffusivity per unit volume, k, is low. In other words, the temporal variation is large. Here, the thermal diffusivity per unit volume, k, can be written again as follows. As is obvious from Formula (4), the unit of the thermal diffusivity per unit volume, k, is [m$^{-1}$·s$^{-1}$]. Further, since the denominator of Formula (4) represents the thermal capacity C [kg/K] of the substance, it can be said that the thermal diffusivity per unit volume, k, is a value obtained by dividing the thermal conductivity λ [W/(m·K)] of the substance by the thermal capacity C [kg/K].

$$k = \frac{1}{V}\frac{\lambda}{\rho c} \tag{4}$$

The thermal diffusivity per unit volume of the collection section 46, $k_C$, and the thermal diffusivity per unit volume of the nozzle covers 43, $k_{NC}$, will be described based on the above description. It should be noted that in reality, the density p, the specific heat c, and the thermal conductivity λ each have a temperature dependency, but recording device 10 according to the present embodiment heats the medium M in a temperature range (e.g., 60° C. through 80° C.) in which the temperature dependencies of the density ρ, the specific heat c, and the thermal conductivity λ are not developed, and therefore, it is assumed that the temperature dependencies of the density ρ, the specific heat c, and the thermal conductivity λ can be ignored.

Firstly, the thermal diffusivity per unit volume of the nozzle covers 43, $k_{NC}$, will be described. As described using FIG. 4, specifically, the nozzle covers 43 are each a thin plate-like member having the length L1 in the width direction X, the length L2 in the front-back direction Y, and the length L3 in the vertical direction Z. Therefore, the volume $V_{NC}$ of each of the nozzle covers 43 is L1×L2×L3. Further, in the present embodiment, since L1=(about 2 cm), L2=(about 5 cm), and L3=(about 0.5 mm) are assumed, the volume $V_{NC}$ of the nozzle cover 43 is about $5\times10^{-7}$ m$^3$. It should be note that the values L1, L2 and L3 described above are merely one example. Here, the nozzle cover 43 is provided with the plurality of holes 43*h* for discharging the ink, but the diameter D2 of each of the holes 43*h* is sufficiently small compared to the lengths L1, L2, and L3. Therefore, it is possible to ignore the influence exerted on the value of the volume $V_{NC}$ of the nozzle cover 43 by the diameter D2 of each of the holes 43*h*. Further, the nozzle covers 43 are formed of stainless steel (SUS). The density ρ of SUS is about 7,750 kg/m$^3$, the specific heat c is about 460 J/(kg·K), and the thermal conductivity λ is about 27.2 W/(m·K). When calculating the thermal diffusivity per unit volume of the nozzle covers 43, $k_{NC}$, using these values and Formula (4), in the present embodiment, about 15 m$^{-1}$·s$^{-1}$ is obtained.

Then, the thermal diffusivity per unit volume of the collection section 46, $k_C$, will be described. As described using FIG. 2 and FIG. 3, the collection section 46 is formed of aluminum (Al). Incidentally, the carriage 41 is also formed of aluminum (Al). In other words, the carriage 41 and the collection section 46 are formed of the same material. The carriage 41 and the collection section 46 are bonded to each other with an adhesive, and it is preferable for the adhesive in the present embodiment to have a thermal conductive property. This can be realized by using, for example, a silicone adhesive including thermally conductive filler such as silver (Ag) as the adhesive. By coupling the collection section 46 to the carriage 41 with the thermally conductive adhesive, it becomes possible to conduct the thermal energy between the carriage 41 and the collection section 46. In other words, by coupling the collection section 46 to the carriage 41 with the thermally conductive adhesive, it is possible to treat the carriage 41 and the collection section 46 as a single system from a thermodynamical point of view. Therefore, in the present embodiment, the "thermal diffusivity of the collection section 46" denotes the thermal diffusivity of the carriage 41 including the collection section 46. In other words, the "thermal diffusivity per unit volume of the collection section 46, $k_C$" in the present embodiment denotes the thermal diffusivity per unit volume of the carriage 41 including the collection section 46.

As shown in FIG. 2 and so on, the shape of the carriage 41 including the collection section 46 is not a simple shape. Therefore, in the present embodiment, the volume $V_{CR}$ of the carriage 41 including the collection section 46 is obtained by numerical calculation from a 3D model corresponding to the carriage 41 including the collection section 46 by way of experiment. The details of the numerical calculation are omitted. In the present embodiment, the volume $V_{CR}$ of the carriage 41 including the collection section 46 is about 0.012 $m^3$. The density ρ of aluminum (Al) is about 2,700 $kg/m^3$, the specific heat c is about 940 J/(kg·K), and the thermal conductivity λ is about 236 W/(m·K). When calculating the thermal diffusivity per unit volume of the carriage 41, $k_C$, including the collection section 46 using these values and Formula (4), in the present embodiment, about 0.0077 $m^{-1}\cdot s^{-1}$ is obtained. It should be note that the value $V_{CR}$ described above is merely one example.

To wrap up the calculation of the thermal diffusivity described hereinabove, the thermal diffusivity per unit volume of the collection section 46, $k_C$, is about 0.0077 $m^{-1}\cdot s^{-1}$, and the thermal diffusivity per unit volume of the nozzle covers 43, $k_{NC}$, is about 15 $m^{-1}\cdot s^{-1}$. Therefore, the thermal diffusivity per unit volume of the collection section 46, $k_C$, is lower than the thermal diffusivity per unit volume of the nozzle covers 43, $k_{NC}$ ($k_C<k_{NC}$).

Here, the function of the configuration in which the thermal diffusivity per unit volume of the collection section 46, $k_C$, is lower than the thermal diffusivity per unit volume of the nozzle covers 43, $k_{NC}$, will be described.

As shown in FIG. 6 and FIG. 7, the ink having adhered to the obverse surface Ma of the medium M is heated by the heaters 34 provided to the support section 30. On this occasion, the temperature of the heaters 34 is set to 60° C. through 80° C., and the ink having adhered to the obverse surface Ma of the medium M is heated in that temperature range. Therefore, the steam existing in the steam generation area ST becomes at a temperature in substantially the same temperature range as that of the heaters 34. On this occasion, when the carriage 41, the nozzle covers 43, and the collection section 46 pass through the steam generation area ST, the carriage 41, the nozzle covers 43, and the collection section 46 have contact with the steam to receive the thermal energy from the steam.

When the carriage 41, the nozzle covers 43, and the collection section 46 have received the thermal energy from the steam, the temperature of the carriage 41, the nozzle covers 43, and the collection section 46 rises with the elapse of time compared to that before receiving the thermal energy from the steam. As described above, the inhibition of the condensation on the nozzle surfaces 43*a* by the collection section 46 in the present embodiment is achieved mainly by the physical adsorption action of the first collection surface 46*a* and the aggregation of the steam on the first collection surface 46*a*. In particular, the latter depends on the temperature of the first collection surface 46*a* and the vicinity of the first collection surface 46*a*. When the temperature of the collection section 46 rises, the temperature of the first collection surface 46*a* and the vicinity of the first collection surface 46*a* also rises. Therefore, the temperature of the first collection surface 46*a* and the vicinity of the first collection surface 46*a* tends to exceed the aggregation temperature of the steam. When the temperature of the first collection surface 46*a* and the vicinity of the first collection surface 46*a* exceeds the aggregation temperature of the steam, it becomes difficult for the aggregation of the steam on the first collection surface 46*a* to occur. For example, when the thermal diffusivity per unit volume of the collection section 46, $k_C$, is equal to or higher than the thermal diffusivity per unit volume of the nozzle covers 43, $k_{NC}$, ($k_C \geq k_{NC}$), the temperature of the collection section 46 is higher than the temperature of the nozzle covers 43 at a certain time point. This is because the collection section 46 tends more to change in temperature per unit time than the nozzle covers 43. In other words, at the certain time point, the temperature of the first collection surface 46*a* and the vicinity of the first collection surface 46*a* tends to exceed the aggregation temperature of the steam. Then, the aggregation action of the steam on the first collection surface 46*a* deteriorates, and it becomes difficult to inhibit the condensation on the nozzle surfaces 43*a*. For example, there is a possibility that the steam aggregates to adhere to the nozzle surfaces 43*a* far from the collection section 46 in the front-back direction Y.

However, the thermal diffusivity per unit volume of the collection section 46, $k_C$, in the present embodiment is lower than the thermal diffusivity per unit volume of the nozzle covers 43, $k_{NC}$ ($k_C<k_{NC}$). Thus, at the certain time point, the temperature of the collection section 46 is lower than the temperature of the nozzle covers 43. In other words, when a predetermined time has elapsed, the state in which the temperature in the vicinity of the collection section 46 is lower than the temperature in the vicinity of the nozzle surfaces 43*a* tends to be realized. Therefore, in the vicinity of the collection section 46, the temperature tends to be equal to or lower than the aggregation temperature of the steam compared to the vicinity of the nozzle surfaces 43*a*. Thus, it is possible to enhance the aggregation effect of the steam in the collection section 46 compared to when the thermal diffusivity per unit volume of the collection section 46, $k_C$, is equal to or higher than the thermal diffusivity per unit volume of the nozzle covers 43, $k_{NC}$ ($k_C \geq k_{NC}$).

It should be noted that in the present embodiment, when calculating the thermal diffusivity $k_C$ per unit volume of the collection section 46, it is assumed that it is possible to conduct the heat between the collection section 46 and the carriage 41 for the sake of simplicity. Further, the "thermal diffusivity per unit volume of the collection section 46, $k_C$" is calculated including the carriage 41. This is because when designing the collection section 46 and the nozzle covers 43 so that the thermal diffusivity per unit volume of the collection section 46, $k_C$, becomes lower than the thermal diffusivity per unit volume of the nozzle covers 43, $k_{NC}$, the magnitude relation between the volume $V_{CR}$ of the collection section 46 and the volume $V_{NC}$ of the nozzle cover 43 and the magnitude relation between the thermal conductivity of the collection section 46 and the thermal conductivity of the nozzle covers 43 become important factors.

The specific description thereof is as follows. In the present embodiment, the volume $V_{CR}$ of the carriage 41 including the collection section 46 is about 0.012 $m^3$, and the volume $V_{NC}$ of the nozzle cover 43 is $V_{NC}$=(about $5\times10^{-7}$ $m^3$). Thus, in the present embodiment, it results in that the volume $V_{CR}$ of the carriage 41 including the collection section 46 is about 24,000 times as large as the volume $V_{NC}$ of the nozzle cover 43. On the other hand, the thermal conductivity λ of the carriage 41 including the collection section 46 is about 236 W/(m·K), and the thermal conductivity λ of the nozzle covers 43 is about 27.2 W/(m·K). Thus, in the present embodiment, it results in that the thermal conductivity λ of the carriage 41 including the collection section 46 is about 8.7 times as high as the thermal conductivity λ of the nozzle covers 43. From the viewpoint of only the thermal conductivity λ, the carriage 41 including the collection section 46 is easier to be heated than the nozzle covers 43. However, taking the thermal diffusivity per unit volume, k, into consideration, when a predetermined time has elapsed, the carriage 41 including the collection section 46 is more difficult to be heated than the nozzle covers 43. Therefore, although from the viewpoint of the material, the carriage 41 including the collection section 46 ought to be easier to be heated than the nozzle cover, since the difference in level of the volume is more dominant compared to the difference in level of the thermal conductivity, there is obtained the configuration in which the carriage 41 including the collection section 46 is more difficult to be heated than the nozzle covers 43. This is because the larger the space to which the thermal energy is transferred is, the longer the time until the thermal energy is transferred to the entire space becomes. Specifically, in the present embodiment, by coupling the collection section 46 to the carriage 41 with the thermally conductive adhesive so as to conduct the heat between the collection section 46 and the carriage 41, the thermodynamic volume of the collection section 46 is increased, and thus, the time until the thermal energy is transferred to the entire area of the carriage 41 including the collection section 46 is elongated.

However, even when the heat is not conducted between the collection section 46 and the carriage 41, when the thermal diffusivity per unit volume of the collection section 46, $k_C$, becomes lower than the thermal diffusivity per unit volume of the nozzle covers 43, $k_{NC}$, other configurations can also be adopted. For example, even when the collection section 46 and the carriage 41 are substantially insulated from each other, it is sufficient that the shape and the material of the collection section 46 are specified. Specifically, it is sufficient that the volume of the collection section 46 alone is defined, and the material constant (e.g., the thermal conductivity) of the material constituting the collection section 46 is determined. On that basis, it is sufficient to arbitrarily optimize the design of the volumes taking the material constant into consideration so that the thermal diffusivity per unit volume of the collection section 46, $k_C$, becomes lower than the thermal diffusivity per unit volume of the nozzle covers 43, $k_{NC}$.

Further, it is possible for the collection section 46 and the carriage 41 to integrally be formed. For example, it is also possible to form the collection section 46 at the same time as forming the carriage 41 by performing the cutting work on an aluminum (Al) material. In other words, it is also possible to use apart of the carriage 41 also as the collection section 46. Thus, compared to when the collection section 46 and the carriage 41 are separate bodies, it is possible to reduce the assembling man-hour, and to suppress a misalignment when coupling the collection section 46 to the carriage 41, and the assembling man-hour necessary to correct the misalignment.

Embodiment 2

Figure 10:
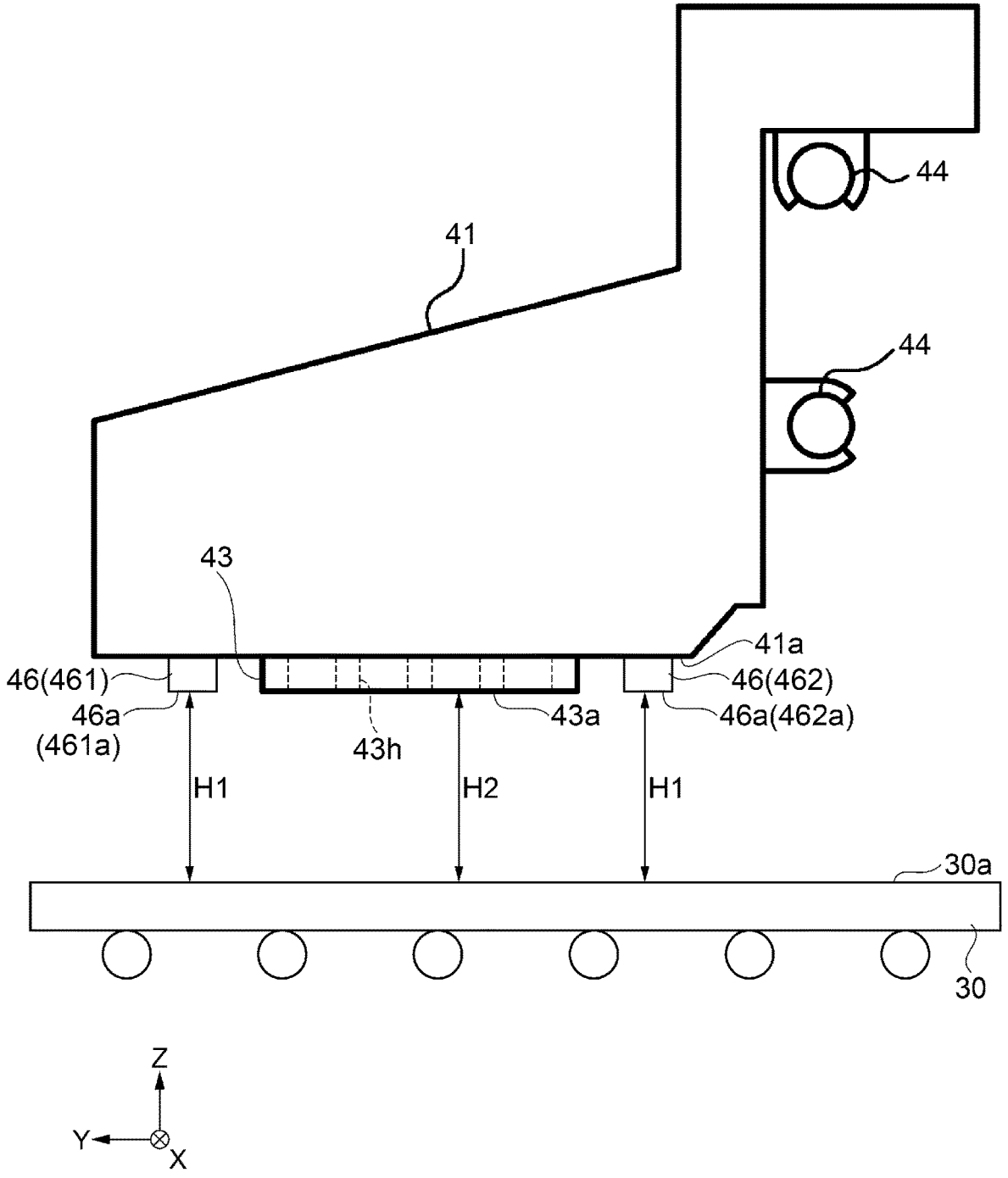
FIG. 10 is a diagram showing an example of an arrangement of a collection section related to Embodiment 2.

FIG. 10 is a diagram showing an example of an arrangement of the collection section 46 related to Embodiment 2 when viewed from the width direction X(−) side.

As shown in FIG. 10, in the front-back direction Y as a second direction intersecting the width direction X(the first direction), the collection section 46 can also include a first collection section 461 located at the front-back direction Y(+) side with respect to the nozzle surfaces 43*a*, and a second collection section 462 located at the front-back direction Y(−) side with respect to the nozzle surfaces 43*a*. In other words, in the second direction intersecting the first direction, the collection section 46 includes the first collection section 461 located at one side in the second direction with respect to the recording heads 42, and the second collection section 462 located at the other side in the second direction with respect to the recording heads 42. In other words, the at least one collection section 46 includes a first collection section 461 and a second collection section 462, and the first collection section 461 and the second collection section 462 are disposed to sandwich the recording heads 42 in the second direction intersecting the first direction. Thus, it is possible to make the two collection sections 46 (461, 462) collect the steam, and therefore, it is possible to further inhibit the condensation on the nozzle surfaces 43*a*. On this occasion, it is preferable for the distance H1 between a first collection surface 461*a* provided to the first collection section 461 and the support surface 30*a* and the distance between a second collection surface 462*a* provided to the second collection section 462 and the support surface 30*a* to be equal to the distance H2 from the support surface 30*a* to the nozzle surfaces 43*a*. Thus, the negative effects when the distance H1 between the first collection surface 461*a* provided to the first collection section 461 and the support surface 30*a* and the distance between the second collection surface 462*a* provided to the second collection section 462 and the support surface 30*a* are different from the distance H2 from the support surface 30*a* to the nozzle surfaces 43*a* are suppressed.

Embodiment 3

Figure 11:
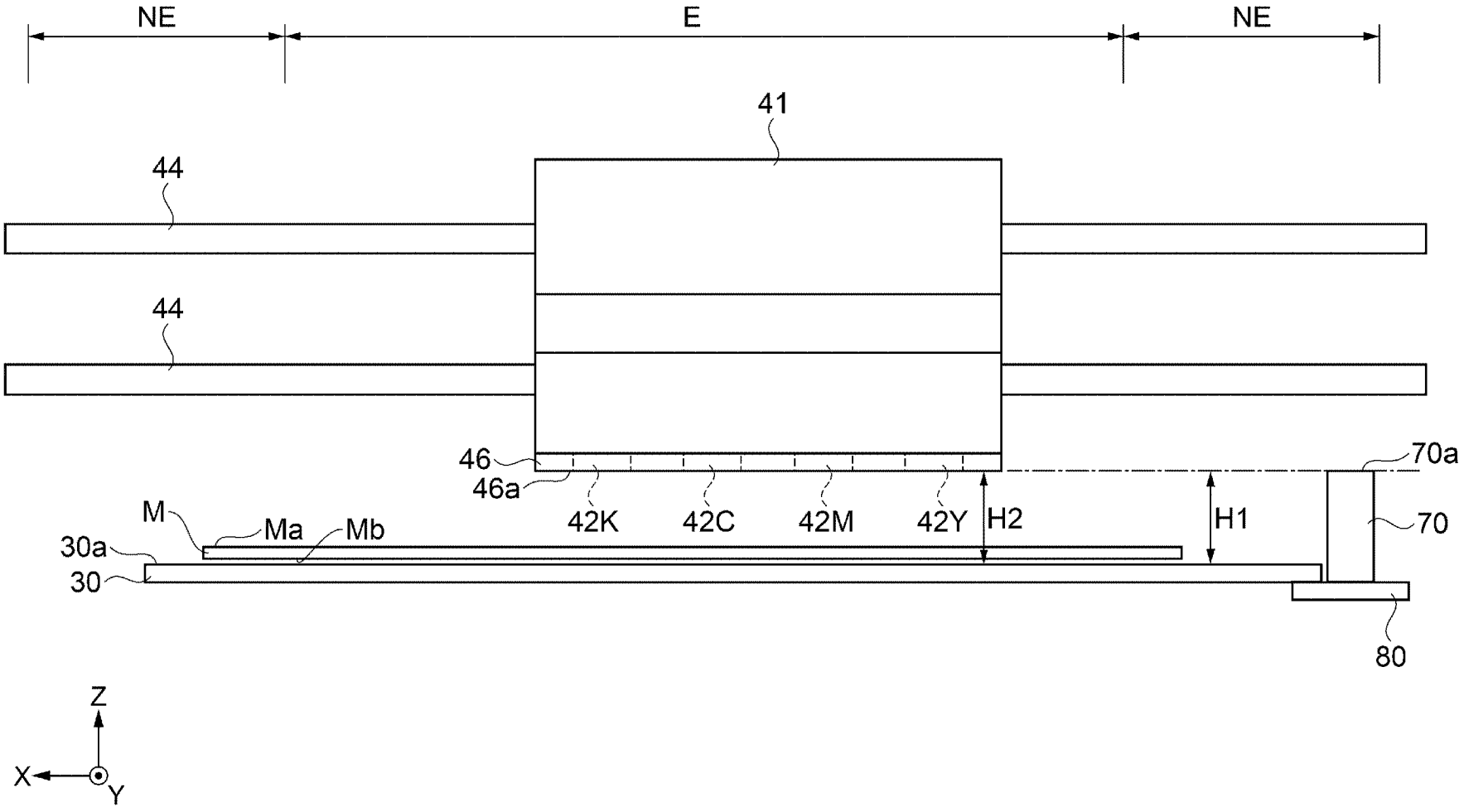
FIG. 11 is a front view of a recording section and a wiper related to Embodiment 3 viewed from the front-back direction Y(+) side.
Figure 12:
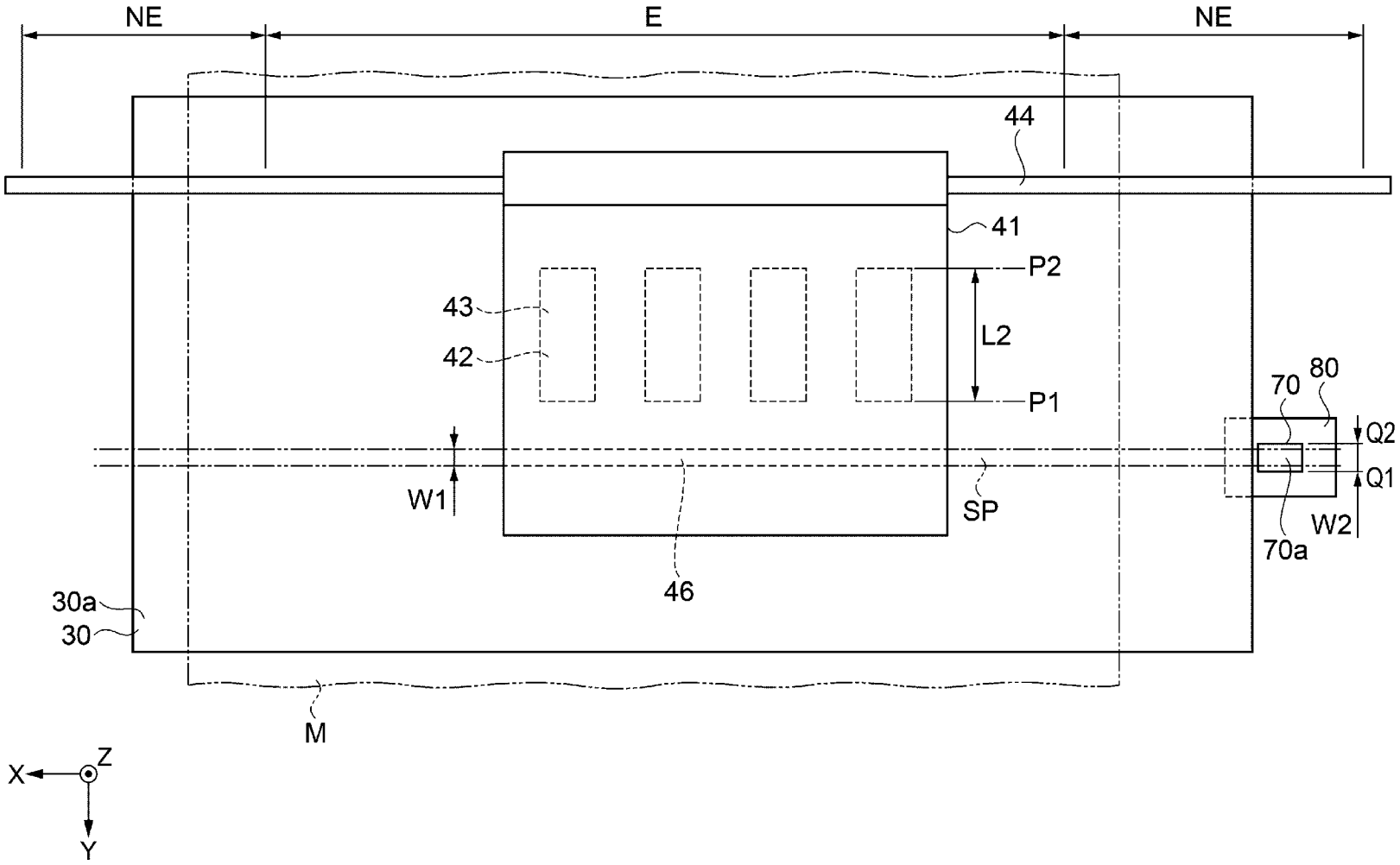
FIG. 12 is a top view of the recording section and the wiper related to Embodiment 3 viewed from a vertical direction Z(+) side.
Figure 13:
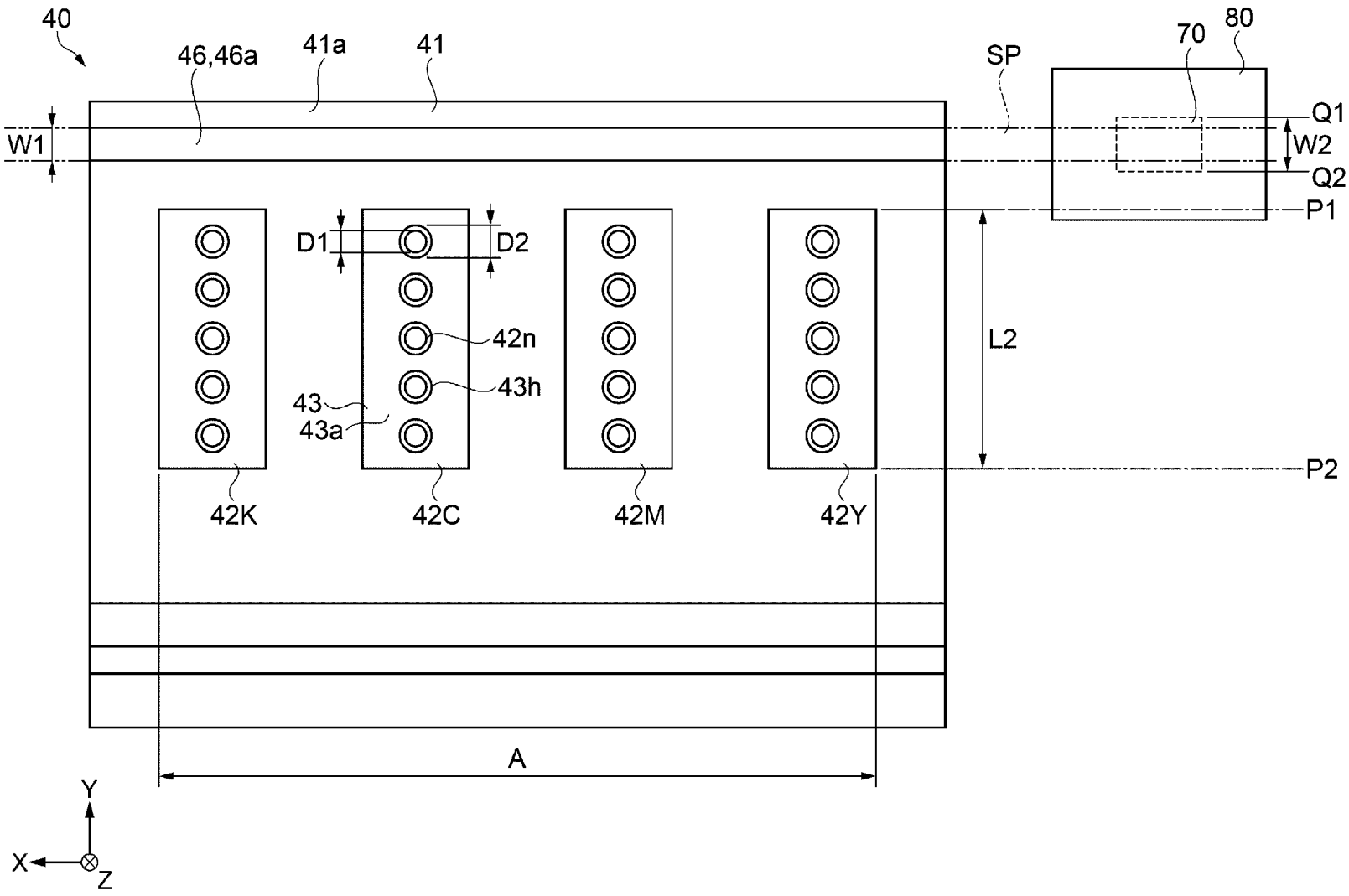
FIG. 13 is a bottom view of a carriage and the wiper related to Embodiment 3 viewed from the vertical direction Z(−) side.
Figure 14:
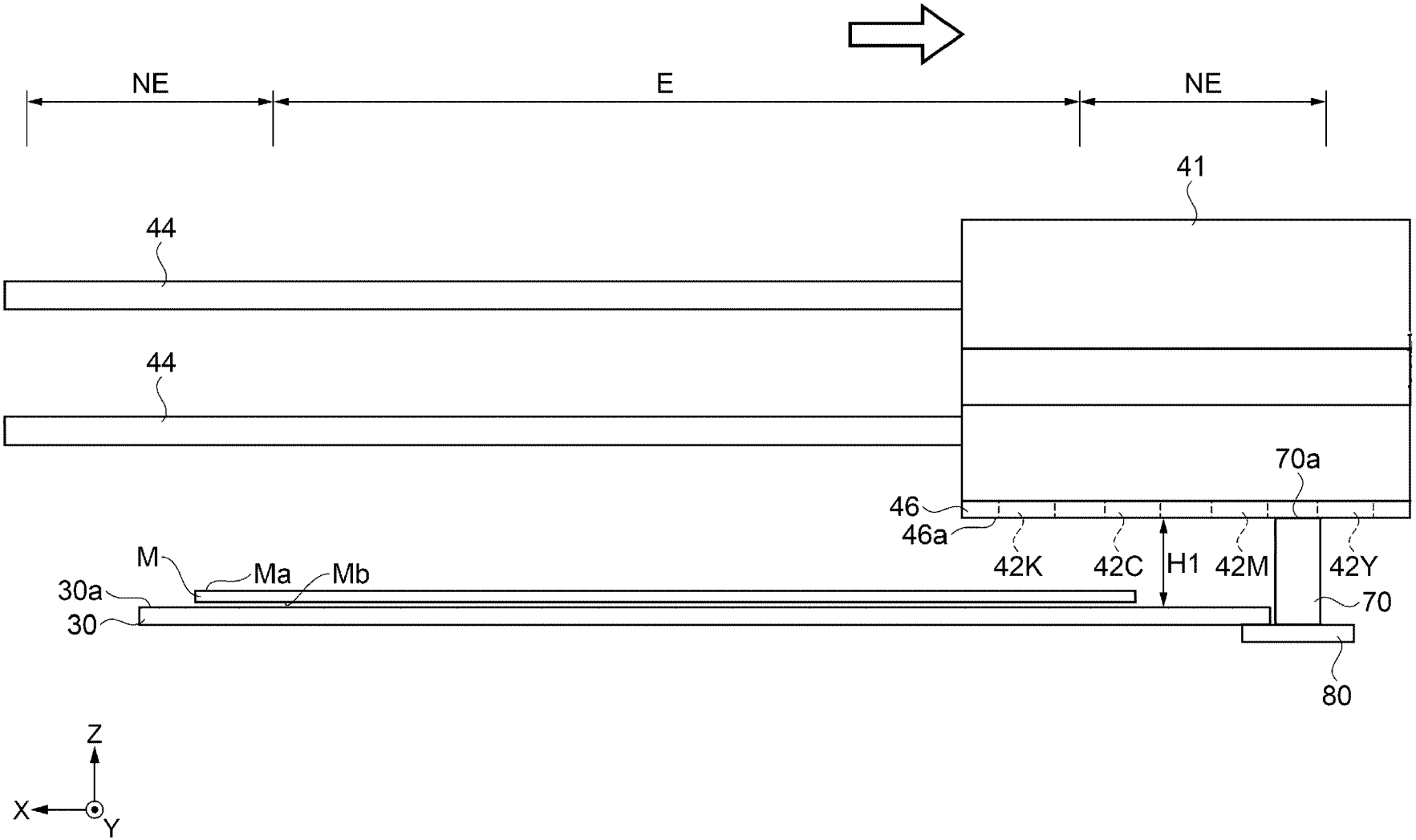
FIG. 14 is a front view of a condition in which the wiper touches a collection section related to Embodiment 3 viewed from the front-back direction Y(+) side.
Figure 15:
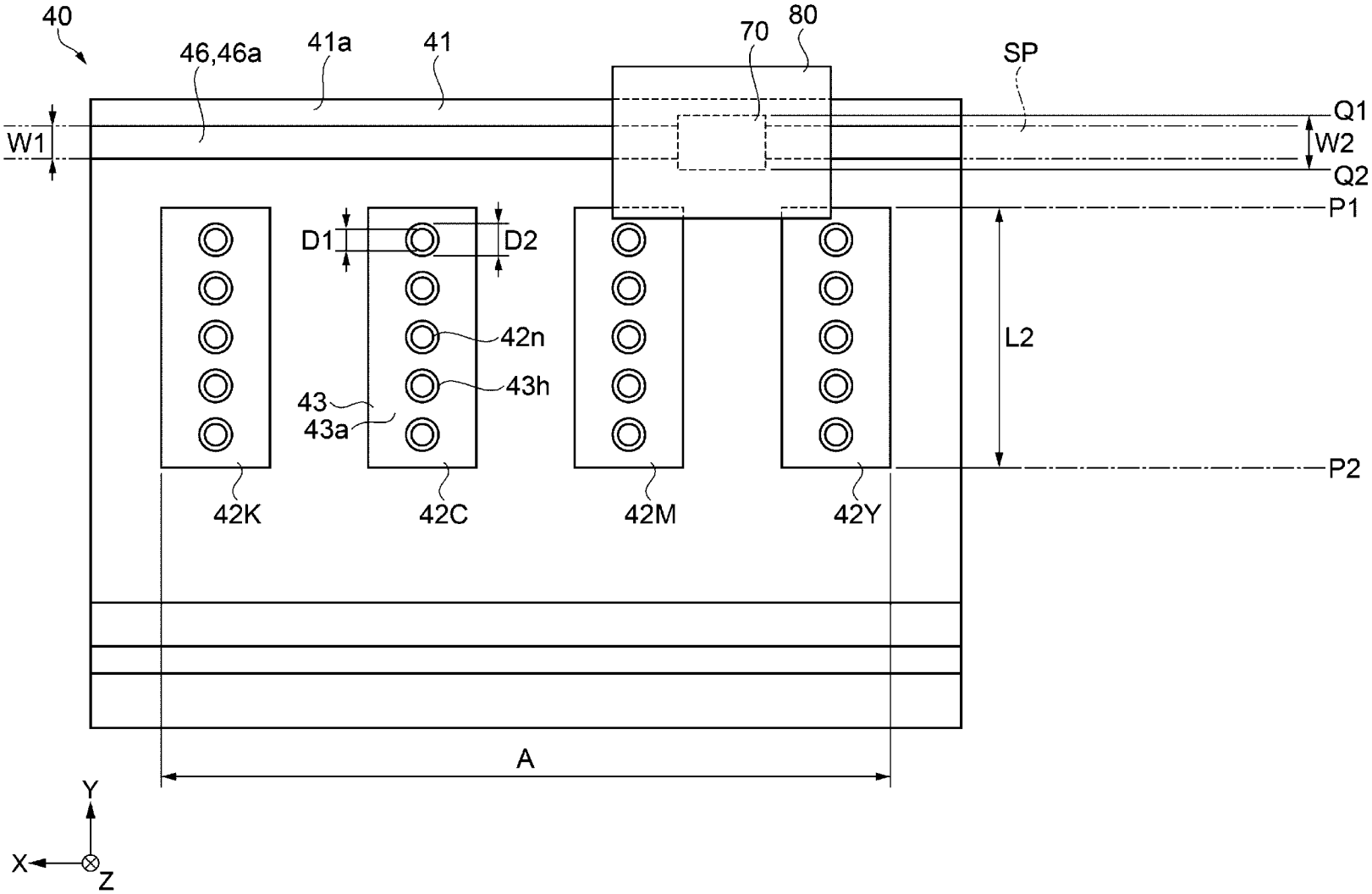
FIG. 15 is a bottom view of a condition in which the wiper touches the collection section related to Embodiment 3 viewed from the vertical direction Z(−) side.

FIG. 11 is a front view of a recording section and a wiper related to Embodiment 3 viewed from the front-back direction Y(+) side. FIG. 12 is a top view of the recording section and the wiper related to Embodiment 3 viewed from the vertical direction Z(+) side. Further, FIG. 13 is a bottom view of a carriage and the wiper related to Embodiment 3 viewed from the vertical direction Z(−) side. Further, FIG. 14 is a front view of a condition in which the wiper touches a collection section related to Embodiment 3 viewed from the front-back direction Y(+) side. Further, FIG. 15 is a bottom view of the condition in which the wiper touches the collection section related to Embodiment 3 viewed from the vertical direction Z(−) side.

As shown in FIG. 11, in the present embodiment, a wiper 70 is disposed in the non-recording area NE on the width direction X(−) side with respect to the recording area E. The wiper 70 includes a sliding contact surface 70*a* on the vertical direction Z(+) side, and is fixed to a wiper base 80 on the vertical direction Z(−) side of the wiper 70. To the sliding contact surface 70*a*, there is attached a material having a water-absorbing property such as unwoven cloth. At least a part of the wiper base 80 is fixed to the support section 30. In this case, the distance between the sliding contact surface 70*a* and the support surface 30*a* is equal to the distance H1 from the support surface 30*a* to the first collection surface 46*a*. Further, the distance between the sliding contact surface 70*a* and the support surface 30*a* is also equal to the distance H2 from the support surface 30*a* to the nozzle surfaces 43*a*. It should be noted that it is also possible for the wiper 70 to be disposed in the non-recording area NE on the width direction X(+) side with respect to the recording area E. Further, it is possible to dispose the collection section 46 also on the front-back direction Y(−) with respect to the nozzle surfaces 43*a*.

As shown in FIG. 12 and FIG. 13, the length in the front-back direction Y of the first collection surface 46*a* is defined as W1, and the length in the front-back direction Y of the wiper 70 is defined as W2. The length W2 in the front-back direction Y of the wiper 70 is longer than the length W1 in the front-back direction Y of the first collection surface 46*a*. It should be noted that the length W2 in the front-back direction Y of the wiper 70 can also be equal to the length W1 in the front-back direction Y of the first collection surface 46*a*. In other words, it is sufficient for the length W2 in the front-back direction Y of the wiper 70 to be equal to or longer than the length W1 in the front-back direction Y of the first collection surface 46*a*. Here, the path through which the collection section 46 passes is defined as SP. The length in the width direction X of the path SP through which the collection section 46 passes is W1, and is equal to the length in the front-back direction Y of the first collection surface 46*a*. In other words, the path SP through which the collection section 46 passes is a trajectory of the collection section 46 when the collection section 46 reciprocates in the width direction X together with the carriage 41. The path SP through which the collection section 46 passes traverses the recording area E and the non-recording area NE, and is parallel to the width direction X. It should be noted that the path SP through which the collection section 46 passes is not required to be parallel to the width direction X. The wiper 70 is disposed at the position overlapping the path SP through which the collection section 46 passes, so as to have contact with the collection section 46. In other words, the wiper 70 configured to have contact with the collection section 46 is disposed on the path SP through which the collection section 46 passes. By disposing the wiper 70 at the position overlapping the path SP through which the collection section 46 passes, it is possible to make the collection section 46 touch the wiper 70 to wipe the steam having adhered to the collection section 46 and the liquid generated by the steam aggregating thereon.

Here, the length L2 in the front-back direction of the nozzle surfaces 43*a* is defined as a range in which the nozzle surfaces 43*a* are disposed in the front-back direction Y. Then, in the range in which the nozzle surfaces 43*a* are disposed in the front-back direction Y, an end on the front-back direction Y(+) side is defined as a first end P1 of the nozzle surfaces 43*a*, and an end on the front-back direction Y(−) side is defined as a second end P2 of the nozzle surfaces 43*a*. In other words, the nozzle surfaces 43*a* are disposed in the range from the first end P1 to the second end P2 in the front-back direction Y. Further, in the range in which the wiper 70 is disposed in the front-back direction Y, an end on the front-back direction Y(+) side is defined as a first end Q1 of the wiper 70, and an end on the front-back direction Y(−) side is defined as a second end Q2 of the wiper 70. In other words, the wiper 70 is disposed in the range from the first end Q1 to the second end Q2 in the front-back direction Y.

In the present embodiment, the second end Q2 in the front-back direction Y of the wiper 70 is located at the front-back direction Y(+) side of the first end P1 in the front-back direction Y of the nozzle surfaces 43*a*. According to such a configuration, it is possible to prevent the wiper 70 from having contact with the nozzle surfaces 43*a* when the collection section 46 reciprocates to have contact with the wiper 70. For example, when the wiper 70 has contact with the nozzle surfaces 43*a* after the wiper 70 has contact with the collection section 46 to wipe the steam and the liquid generated by the steam aggregating on the collection section 46, there is a possibility that the nozzle surfaces 43*a* get dirty with the liquid having adhered to the wiper 70. In contrast, since the second end Q2 in the front-back direction Y of the wiper 70 is located at the front-back direction Y(+) side of the first end P1 in the front-back direction Y of the nozzle surfaces 43*a*, it is possible to prevent the nozzle surfaces 43*a* from getting dirty.

Then, the condition in which the wiper 70 has contact with the collection section 46 will be described using FIG. 14 and FIG. 15.

FIG. 14 shows a state in which the carriage 41 moves from the recording area E toward the width direction X(−) side, and is then located in the non-recording area NE. In accordance with the carriage 41 moving toward the width direction X(−) side, the collection section 46 also moves toward the width direction X(−) side. Shortly, at least a part of the collection section 46 reaches the non-recording area NE on the width direction X(−) side. Then, the sliding contact surface 70*a* of the wiper 70 has contact with the first collection surface 46*a*, and in accordance with the carriage 41 moving toward the width direction X(−) side, the wiper 70 wipes out the liquid having adhered to the first collection surface 46*a*. Thus, it is possible to wipe out the liquid having aggregated in the collection section 46 with the wiper 70 to suppress the amount of the liquid accumulated in the collection section 46. Thus, it is possible to prevent the liquid generated by aggregating the steam collected by the collection section 46 from dropping on the obverse surface Ma of the medium M. FIG. 15 is a diagram of the carriage 41 and the wiper 70 viewed from the vertical direction Z(−) side in the state shown in FIG. 14. It is understood that since the second end Q2 in the front-back direction Y of the wiper 70 is located at the front-back direction Y(+) side of the first end P1 in the front-back direction Y of the nozzle surfaces 43*a*, the nozzle surfaces 43*a* do not have contact with the wiper 70 even when the collection section 46 has contact with the wiper 70. It should be noted that although in the present embodiment, there is adopted the configuration in which the sliding contact surface 70*a* of the wiper 70 has contact only with the first collection surface 46*a* out of the collection section 46, it is also possible to adopt a configuration in which the sliding contact surface 70*a* of the wiper 70 has contact also with the second collection surfaces 46*b*. For example, when the sliding contact surface 70*a* of the wiper 70 is in a raised state as in raised fabric, or in a brushy state, the state in which the sliding contact surface 70*a* of the wiper 70 has contact also with the second collection surfaces 46*b* can be realized.

The present disclosure is not limited to the embodiments described above, but can arbitrarily be modified and combined within the scope or the spirit of the present disclosure which can be read from the appended claims and the entire specification, and a variety of modified examples are possible besides the embodiments described above. Some modified examples will hereinafter be described.

Modified Example 1

In the embodiments described above, the material constituting the collection section 46 is aluminum (Al), but this is not a limitation. As the material for constituting the collection section 46, it is also possible to use a metal material such as copper (Cu) or titanium (Ti). Even when adopting such a configuration, it is possible to obtain substantially the same functions and advantages as those of the embodiments described above.

Modified Example 2

Figure 16:
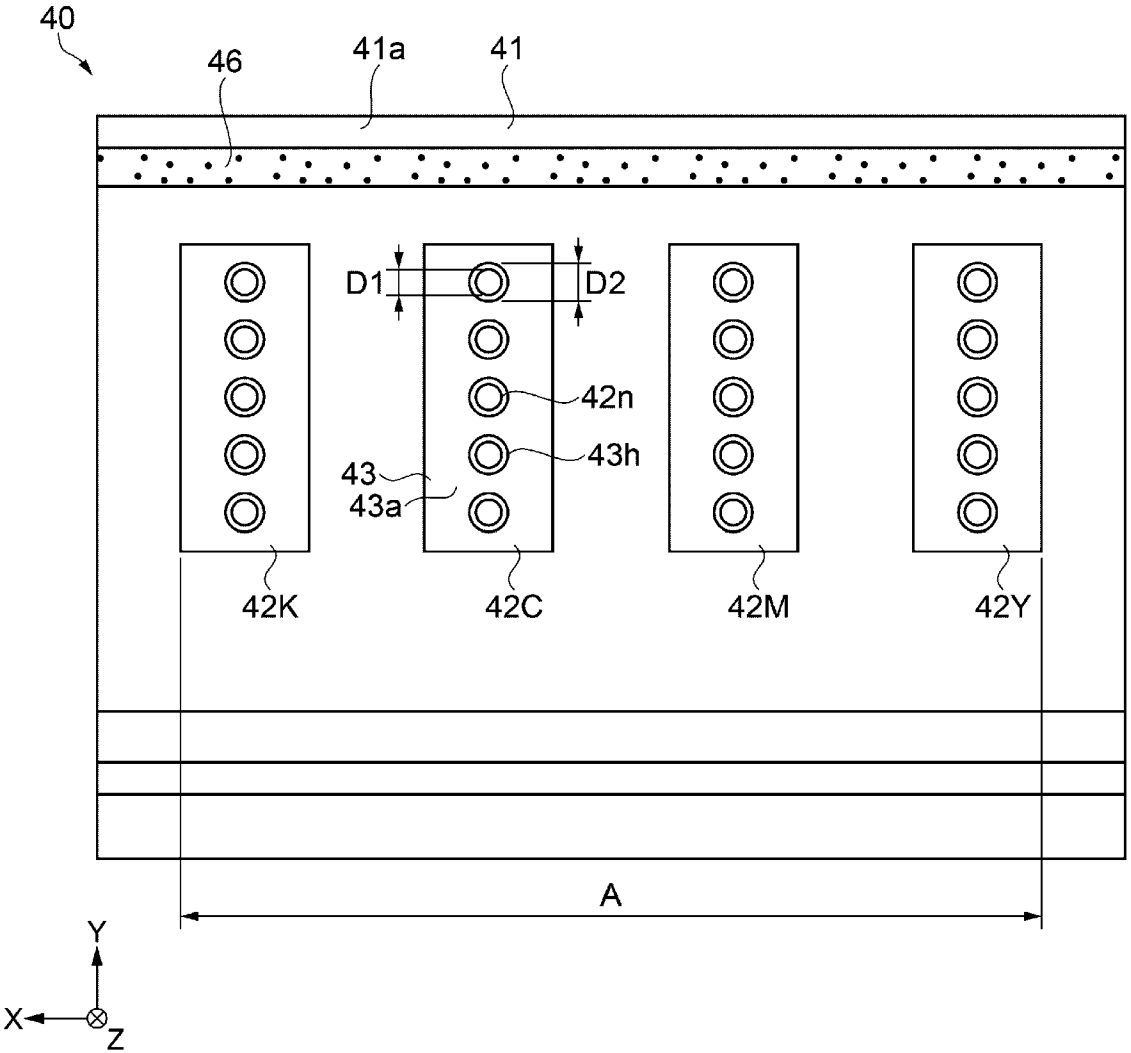
FIG. 16 is a bottom view of a collection section related to Modified Example 2 viewed from the vertical direction Z(−) side.

In the embodiments described above, the hydrophilic property and the physical adsorption action are developed by processing the first collection surface 46*a* and the second collection surfaces 46*b* of the collection section 46 so as to have a predetermined surface roughness, but this is not a limitation. For example, as shown in FIG. 16, it is also possible to develop the hydrophilic property by forming a plurality of fine pores having an average diameter of about 1 mm through 5 mm in at least one of the first collection surface 46*a* and the second collection surfaces 46*b*. Specifically, it is also possible to develop the physical adsorption action by forming the plurality of fine pores on the surface of a carbon fiber sheet, a porous material such as mesoporous silica or zeolite, or metal. In this case, it is possible to measure and evaluate the diameters of the fine pores using a known mercury intrusion porosimeter or the like.

Modified Example 3

Figure 17:
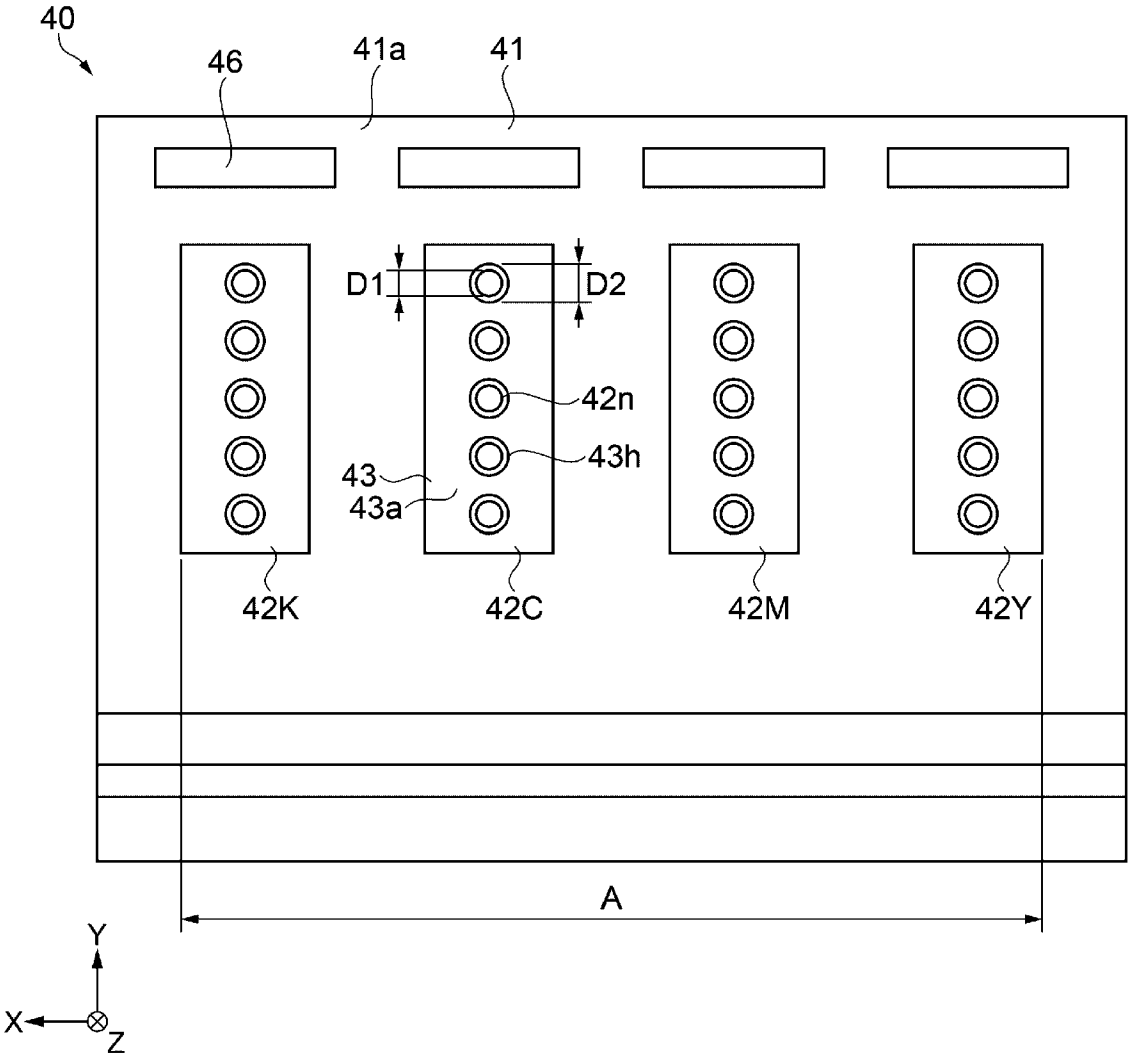
FIG. 17 is a bottom view of a collection section related to Modified Example 3 viewed from the vertical direction Z(−) side.
Figure 18:
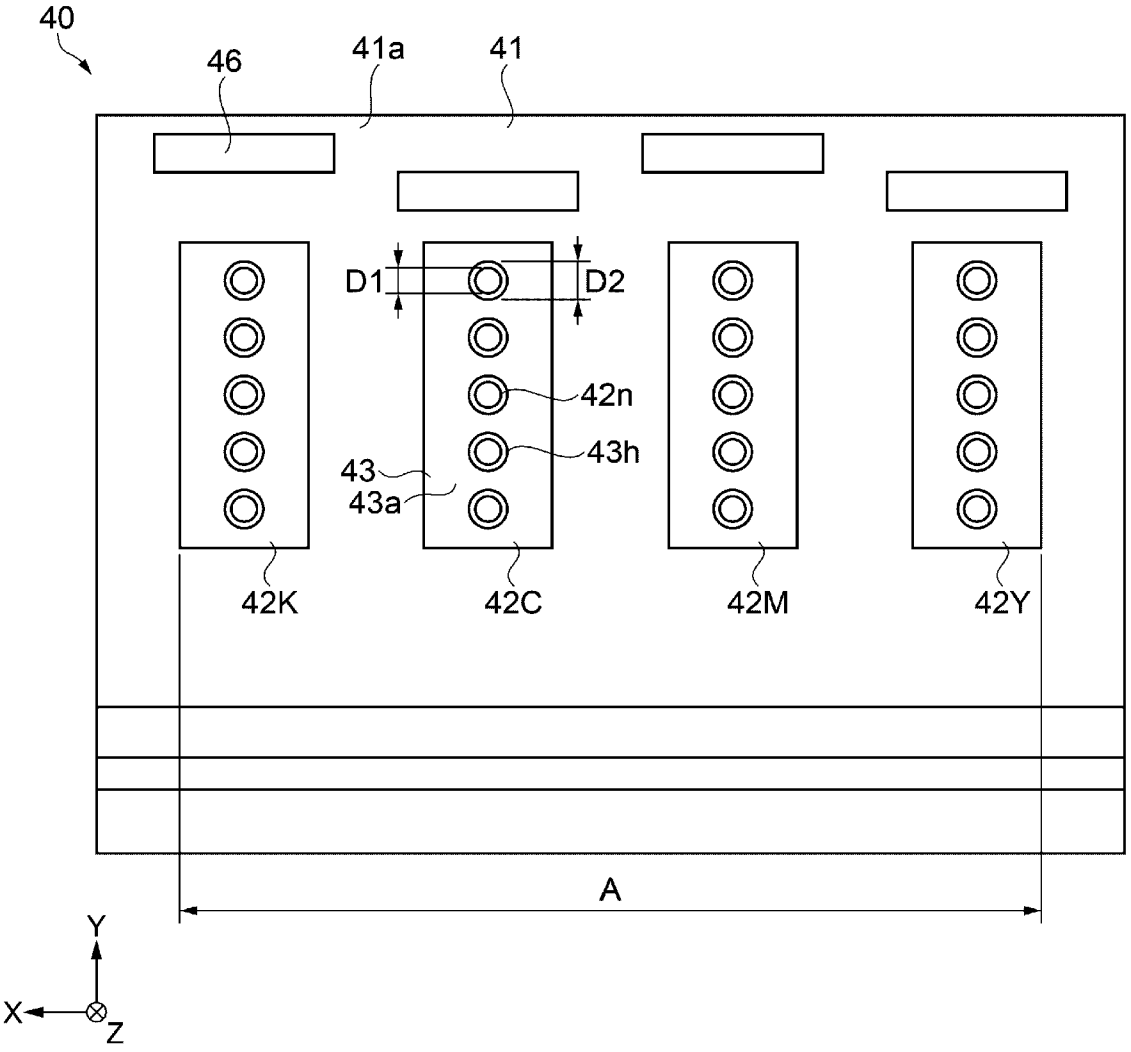
FIG. 18 is a bottom view of a collection section related to Modified Example 3 viewed from the vertical direction Z(−) side.

In the embodiments described above, the collection section 46 is disposed in the range larger than the range A in which the nozzle surfaces 43*a* are disposed and the same range as the length in the width direction X of the lower surface 41*a* of the carriage 41 in the width direction X, but this is not a limitation. For example, as shown in FIG. 17, it is also possible to dispose a plurality of collection sections 46 in the width direction X. Alternatively, as shown in FIG. 18, it is also possible to dispose a plurality of collection sections 46 in a zigzag manner in the width direction X. In this case, it is preferable for the length of each of the collection sections 46 in the width direction X to be longer than the length of each of the nozzle surfaces 43*a* in the width direction X. Further, it is preferable for at least a part of the nozzle surfaces 43*a* to overlap the collection sections 46 in the front-back direction Y. Even when adopting such a configuration, it is possible to obtain substantially the same functions and advantages as those of the embodiments described above.

Modified Example 4

In the embodiments described above, the collection section 46 includes a rectangular shape viewed from the vertical direction Z, but this is not a limitation. It is also possible to adopt a variety of shapes such as an elliptical shape. Even when adopting such a configuration, it is possible to obtain substantially the same functions and advantages as those of the embodiments described above.

Modified Example 5

Figure 19:
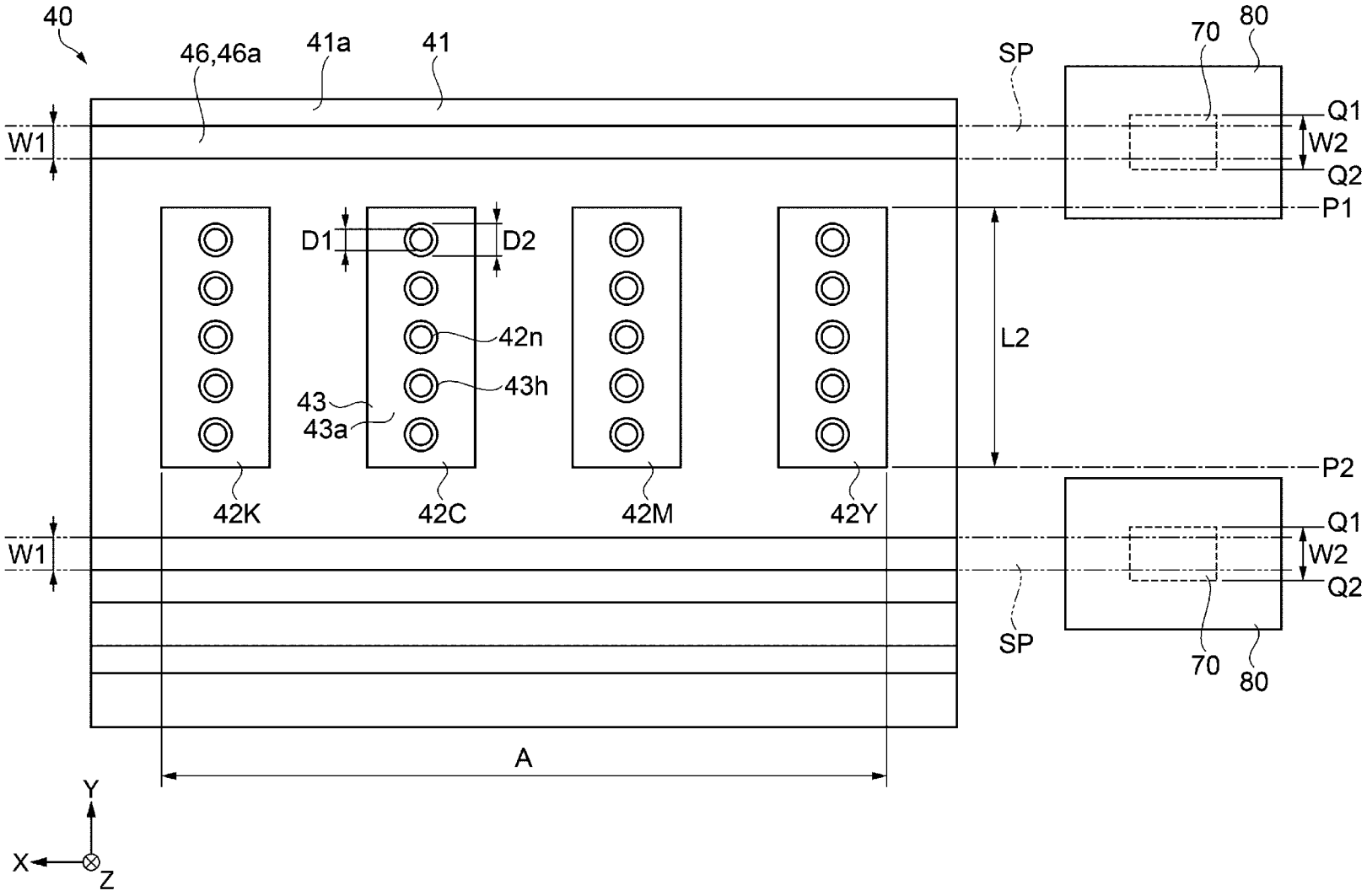
FIG. 19 is a bottom view of a collection section and a wiper related to Modified Example 5 viewed from the vertical direction Z(−) side.

In the embodiment described above, the wiper 70 is disposed at the front-back direction Y(+) side with respect to the nozzle surfaces 43*a* so as to correspond to the collection section 46 disposed at the front-back direction Y(+) side with respect to the nozzle surfaces 43*a*, but this is not a limitation. For example, when the collection section 46 is also disposed at the front-back direction Y(−) side with respect to the nozzle surfaces 43*a*, it is also possible to dispose the wiper 70 at the position overlapping the path SP through which the collection section 46 passes. In this case, as shown in FIG. 19, it is preferable for the first end Q1 in the front-back direction Y of the wiper 70 to be located at the front-back direction Y(−) side of the second end P2 in the front-back direction Y of the nozzle surfaces 43*a*. According to such a configuration, it is possible to prevent the wipers 70 from having contact with the nozzle surfaces 43*a* when the collection sections 46 reciprocate to have contact with the wipers 70 similarly to the embodiment described above. Even when adopting such a configuration, it is possible to obtain substantially the same functions and advantages as those of the embodiments described above.

Modified Example 6

Figure 20:
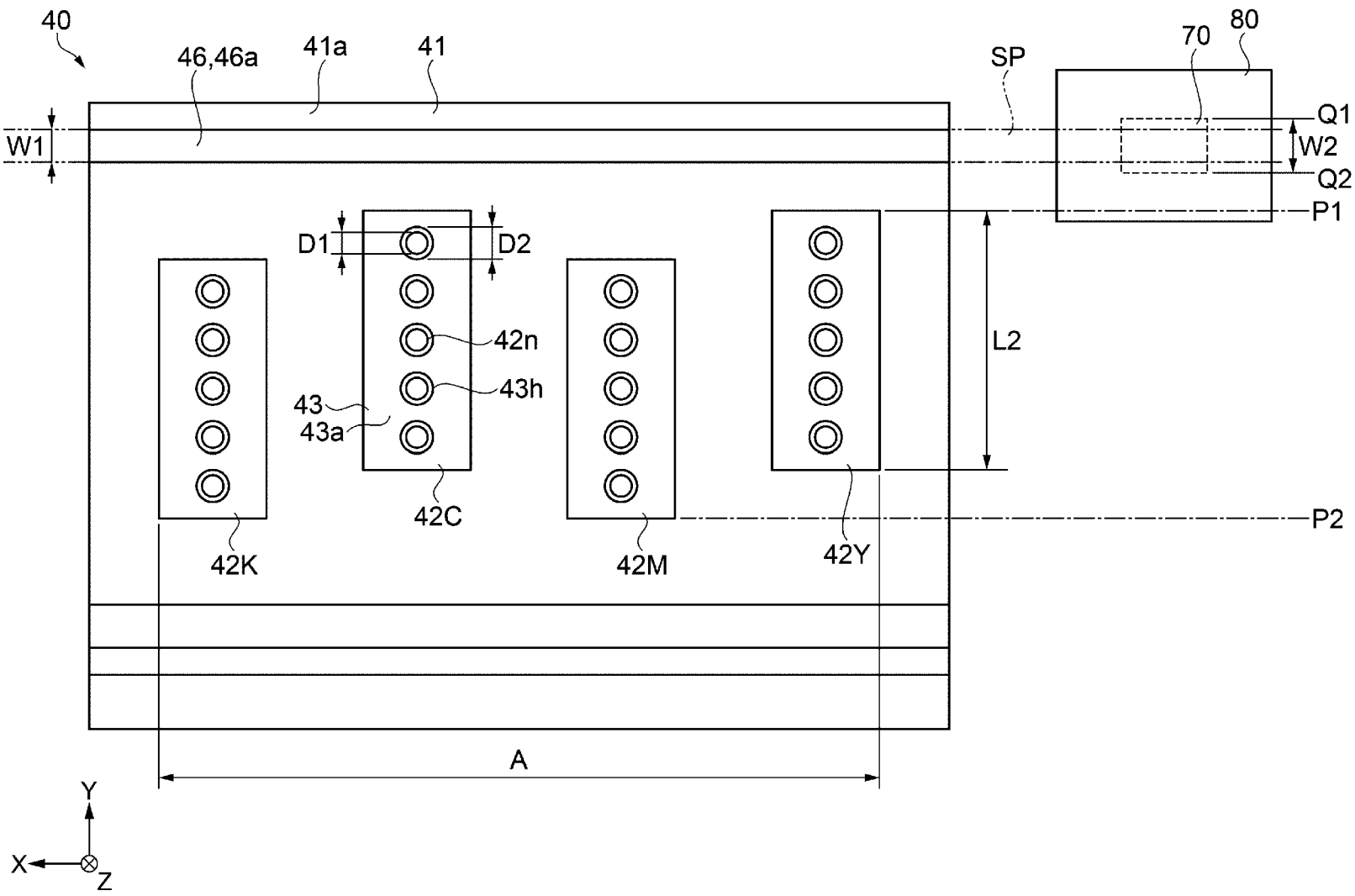
FIG. 20 is a bottom view of a nozzle surface and a wiper related to Modified Example 6 viewed from the vertical direction Z(−) side.

In the embodiments described above, the definition of when the plurality of nozzle surfaces 43*a* are arranged along the width direction X is described with respect to the first end P1 and the second end P2, but this is not a limitation. For example, when the plurality of nozzle surfaces 43*a* is arranged in a zigzag manner in the width direction X as shown in FIG. 20, the position of the first end P1 is determined so as to correspond to the nozzle surfaces 43*a* corresponding respectively to the recording head 42C and recording head 42Y. Further, the position of the second end P2 is determined so as to correspond to the nozzle surfaces 43*a* corresponding respectively to the recording head 42K and the recording head 42M. Further, it is possible to adjust the position of the wiper 70 in accordance with the first end P1 or the second end P2. Even when adopting such a configuration, it is possible to obtain substantially the same functions and advantages as those of the embodiments described above.

Modified Example 7

Figure 21:
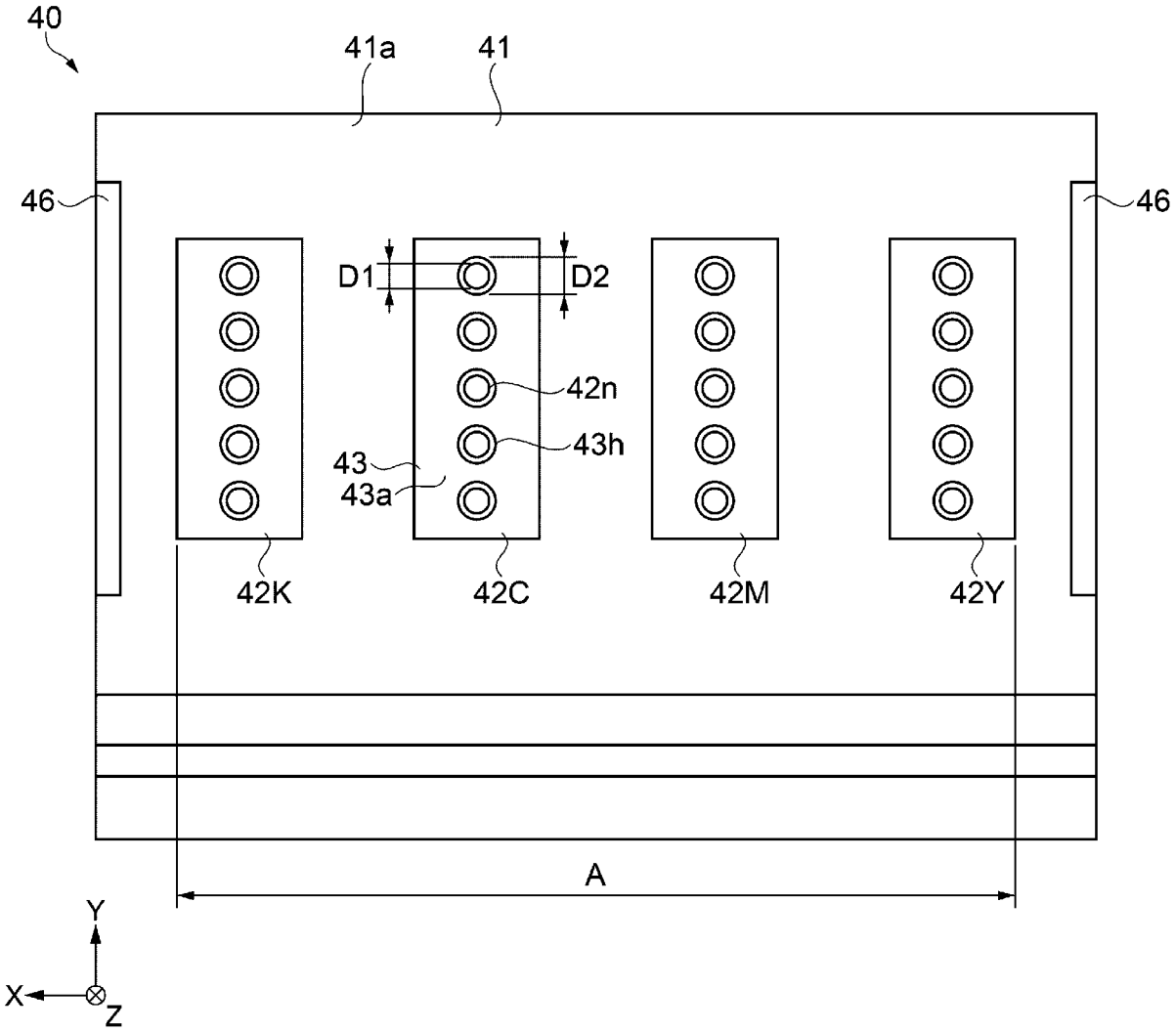
FIG. 21 is a bottom view of a nozzle surface and a collection section related to Modified Example 7 viewed from the vertical direction Z(−) side.
Figure 22:
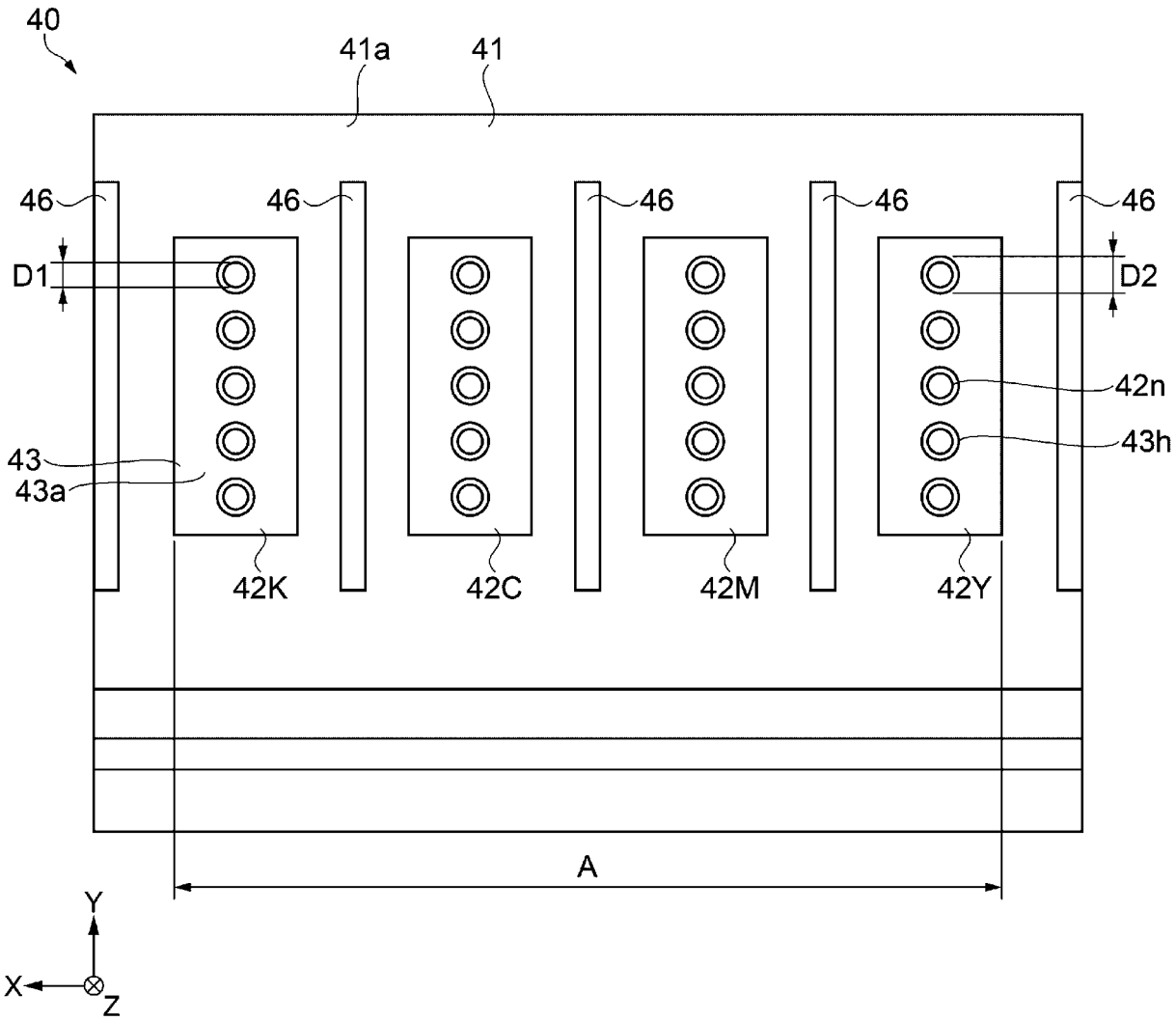
FIG. 22 is a bottom view of the nozzle surface and the collection section related to Modified Example 7 viewed from the vertical direction Z(−) side.

In the embodiments described above, as an example of the configuration in which the collection section 46 is disposed at the lower surface 41*a* of the carriage 41 and at the position different from the nozzle surfaces 43*a*, the collection section 46 is disposed at at least one of the front-back direction Y(+) side with respect to the nozzle surfaces 43*a* and the front-back direction Y(−) side with respect to the nozzle surfaces 43*a*, but this is not a limitation. For example, it is also possible for the collection sections 46 to be disposed at both of the width direction X(+) side with respect to the recording head 42K, and the width direction X(−) side with respect to the recording head 42Y as shown in FIG. 21. Alternatively, it is also possible for the collection sections 46 to be disposed at either one of the width direction X(+) side with respect to the recording head 42K, and the width direction X(−) side with respect to the recording head 42Y. In other words, it is also possible for the collection section 46 to be disposed at at least one of the width direction X(+) side with respect to the recording head 42K, and the width direction X(−) side with respect to the recording head 42Y. Even when adopting such a configuration, it is possible to obtain substantially the same functions and advantages as those of the embodiments described above. Alternatively, as shown in FIG. 22, it is also possible to dispose the collection sections 46 alternately with the respective recording heads 42 in the width direction X. Further, in this case, it is also possible to dispose the collection section 46 on at least one of the front-back direction Y(+) side with respect to the nozzle surfaces 43*a*, and the front-back direction Y(−) side with respect to the nozzle surfaces 43*a* in addition to the width direction X. Even when adopting such a configuration, it is possible to obtain substantially the same functions and advantages as those of the embodiments described above.

Modified Example 8

As the recording device 10 according to the embodiments described above, it is also possible to adopt a liquid discharge device for jetting or discharging other fluids than the ink. For example, the present disclosure can be diverted to a variety of recording devices equipped with a head or the like for discharging minute amount of droplets. It should be noted that it is assumed that the droplet means a state of a liquid to be discharged from the recording device described above, and includes a granular droplet, a droplet like a teardrop, and a droplet trailing like a thread. Further, it is sufficient for the liquid mentioned here to be a material which can be discharged (jetted) by a liquid discharge device. For example, it is sufficient to be in the state in which the substance is in the liquid phase, and there are included not only a liquid body high or low in viscosity, an inorganic solvent such as sol, or gel water, an organic solvent, a solution, a fluid such as liquid resin or liquid metal (metal melt), and a liquid as one state of a substance, but also what is obtained by dissolving, dispersing, or mixing particles of a functional material formed of a solid body such as pigments or metal particles in a solvent, and so on. Further, as a representative example of the liquid, it is possible to cite the ink described in the above embodiments. Here, the ink should include a variety of liquid compositions such as common aqueous ink, oil ink, and gel ink, and hot-melt ink. Further, as the medium, there should be included functional paper which is thin and thermally elongates, textile such as cloth or fabric, a substrate, a metal plate, and so on besides a plastic film such as a vinyl chloride film.

Hereinafter, the contents derived from the embodiments described above will be described.

The recording device according to the present disclosure includes a carriage configured to reciprocate in a first direction, a recording head housed in the carriage, and configured to discharge a droplet on an obverse surface of a medium to perform recording on the medium, a support section including a support surface configured to support a reverse surface of the medium, and a heating section configured to heat the droplet adhered to the obverse surface of the medium, wherein the carriage includes at least one collection section configured to collect steam generated when the droplet is heated by the heating section, the recording head includes a nozzle cover provided with a plurality of holes configured to discharge the droplet, the nozzle cover includes a nozzle surface opposed to the support surface, and the collection section is formed of a material higher in hydrophilic property than the nozzle surface, and is disposed at a lower surface of the carriage, and at a position different from the nozzle surface.

In the recording device according to the present disclosure, the carriage is provided with the collection section capable of collecting the steam, and the collection section is formed of the material higher in hydrophilic property than the nozzle surface, and is disposed at the lower surface of the carriage and at the position different from the nozzle surface. Thus, even when the recording head passes through the steam generation area, the steam tends to adhere to the collection section higher in hydrophilic property than the nozzle surfaces, and thus, the condensation on the nozzle surface can be prevented. This is because the collection section is higher in wettability with respect to water compared to the nozzle surface.

In the recording device according to the present disclosure, a thermal diffusivity per unit volume of the at least one collection section may be lower than a thermal diffusivity per unit volume of the nozzle cover.

The collection action of the steam by the collection section is achieved by the physical adsorption based on the hydrophilic property of the collection section, and the aggregation of the steam on the collection section. According to the configuration described above, at the certain time point, the temperature of the collection section is lower than the temperature of the nozzle cover. In other words, since the temperature in the vicinity of the collection section is lower than the temperature in the vicinity of the nozzle surface when a predetermined time has elapsed, in the vicinity of the collection section, the temperature is lower than an aggregation temperature of the steam. Thus, it is possible to enhance the aggregation action of the steam in the collection section. It should be noted that when calculating the volume of the collection section, not only the volume of the collection section, the configuration in the vicinity of the collection section to which the thermal energy can be transferred, is also calculated. For example, when the heat can be conducted between the collection section and the carriage (e.g., when the collection section is coupled to the carriage with a thermally conductive adhesive), the volume of the carriage is added to the volume of the collection section. This is because when delivery and receipt of the thermal energy occurs in the collection section, the thermal energy is also transferred to the carriage, and as a result, the volume of the collection section virtually increases by the amount of the volume of the carriage thermodynamically.

In the recording device according to the present disclosure, the at least one collection section may integrally be formed with the carriage.

According to the configuration described above, compared to when the collection section and the carriage are separate bodies, it is possible to reduce the assembling man-hour, and to suppress a misalignment when coupling the collection section to the carriage, and the assembling man-hour necessary to correct the misalignment.

In the recording device according to the present disclosure, the at least one collection section may include a first collection section and a second collection section, and the first collection section and the second collection section are disposed to sandwich the recording head in a second direction intersecting the first direction.

According to the configuration described above, it is possible to make the two collection sections collect the steam, and therefore, it is possible to further inhibit the condensation on the nozzle surface.

In the recording device according to the present disclosure, the collection section may have a collection surface opposed to the support surface, and a distance from the support surface to the collection surface may be equal to a distance from the support surface to the nozzle surface.

There are two cases when the distance between the collection surface and the support surface is different from the distance between the nozzle surface and the support surface. The first case is when the distance between the collection surface and the support surface is longer than the distance between the nozzle surface and the support surface. In this case, since the distance for the steam to reach the collection surface becomes long, there is a possibility that the steam adheres to the nozzle surface before reaching the collection surface. The second case is when the distance between the collection surface and the support surface is shorter than the distance between the nozzle surface and the support surface. In this case, when the steam collected by the collection surface aggregates to become a liquid, there is a possibility that the liquid tends to have contact with the obverse surface of the medium.

In contrast, according to the configuration described above, the collection section in the present embodiment includes the collection surface opposed to the support surface. Further, the distance between the collection surface and the support surface is equal to the distance between the nozzle surface and the support surface. In other words, the height from the support surface to the collection surface and the height from the support surface to the nozzle surface are equal to each other. Thus, the negative effects when the height from the support surface to the collection surface and the height from the support surface to the nozzle surface are different from each other are prevented. Therefore, it is possible to further enhance the collection effect of the steam by the collection surface, and to prevent the liquid which is generated when the steam collected by the collection surface aggregates to become the liquid from having contact with the obverse surface of the medium to make the obverse surface dirty.

In the recording device according to the present disclosure, a surface roughness of the collection surface may be higher than a surface roughness of the nozzle surface.

According to the configuration described above, due to the fact that the surface roughness of the collection surface is higher than the surface roughness of the nozzle surface, the collection surface becomes higher in surface free energy than the nozzle surface. Then, since the collection surface becomes stronger than the nozzle surface in the action of decreasing the surface free energy, the steam tends to be adsorbed to the collection surface. Thus, it is possible to further prevent the condensation on the nozzle surfaces.

In the recording device according to the present disclosure, the surface roughness of the collection surface may be no less than 0.012 μm and no more than 6.3 μm.

The size of the particles constituting the steam is within a range of about 0.01 μm through 6 μm. According to the configuration described above, the surface roughness of the collection surface is set to no less than 0.012 μm and no more than 6.3 μm so as to incorporate the range of the size of the particles of the steam. Thus, it is possible to take the particles constituting the steam in the collection surface to adsorb the steam to the collection surface. Therefore, it is possible to further enhance the collection action by the collection section.

In the recording device according to the present disclosure, may further includes a wiper configured to have contact with the collection section and is disposed on a path through which the collection section passes.

The steam collected by the collection section aggregates and accumulates with time, and then liquefies. According to the configuration described above, it is possible to wipe out the liquid having aggregated in the collection section with the wiper to suppress the amount of the liquid accumulated in the collection section. Thus, it is possible to prevent the liquid generated by aggregating the steam collected by the collection section from dropping on the obverse surface of the medium.

What is claimed is:

1. A recording device comprising:

a carriage configured to reciprocate in a first direction;

a recording head housed in the carriage, and configured to discharge a droplet on an obverse surface of a medium to perform recording on the medium;

a support section including a support surface configured to support a reverse surface of the medium; and a heating section configured to heat the droplet adhered to the obverse surface of the medium, wherein the carriage is provided with at least one collection section configured to collect steam generated when the droplet is heated by the heating section, the recording head includes a nozzle cover provided with a plurality of holes configured to discharge the droplet, the nozzle cover includes a nozzle surface opposed to the support surface, and the collection section is formed of a material higher in hydrophilic property than the nozzle surface, and is disposed at a lower surface of the carriage, and at a position different from the nozzle surface.

2. The recording device according to claim 1, wherein a thermal diffusivity per unit volume of the at least one collection section is lower than a thermal diffusivity per unit volume of the nozzle cover.

3. The recording device according to claim 1, wherein the at least one collection section is integrally formed with the carriage.

4. The recording device according to claim 1, wherein the at least one collection section includes a first collection section and a second collection section, and the first collection section and the second collection section are disposed to sandwich the recording head in a second direction intersecting the first direction.

5. The recording device according to claim 1, wherein the at least one collection section includes a collection surface opposed to the support surface, and a distance from the support surface to the collection surface is equal to a distance from the support surface to the nozzle surface.

6. The recording device according to claim 5, wherein a surface roughness of the collection surface is higher than a surface roughness of the nozzle surface.

7. The recording device according to claim 6, wherein the surface roughness of the collection surface is no less than 0.012 μm and no more than 6.3 μm.

8. The recording device according to claim 1, further comprising:

a wiper configured to have contact with the collection section and is disposed on a path through which the collection section passes.

* * * * *